US010948857B2

(12) United States Patent
Okayasu et al.

(10) Patent No.: US 10,948,857 B2
(45) Date of Patent: Mar. 16, 2021

(54) IMAGE FORMING APPARATUS, IMAGE FORMING SYSTEM, AND IMAGE FORMING METHOD EACH CONTROLLING FIXING TEMPERATURE

(71) Applicant: CANON KABUSHIKI KAISHA, Tokyo (JP)

(72) Inventors: Kohei Okayasu, Mishima (JP); Masashi Tanaka, Kawasaki (JP); Shingo Ito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/848,205

(22) Filed: Apr. 14, 2020

(65) Prior Publication Data

US 2020/0241454 A1 Jul. 30, 2020

Related U.S. Application Data

(63) Continuation of application No. 16/388,514, filed on Apr. 18, 2019, now Pat. No. 10,656,576.

(30) Foreign Application Priority Data

Apr. 26, 2018 (JP) ..... JP2018-085294

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/2042; G03G 15/2046; G03G 15/205
See application file for complete search history.

(56) References Cited

U.S. PATENT DOCUMENTS

2015/0286174 A1* 10/2015 Yamamoto ..... G03G 15/2039 399/69
2016/0246225 A1* 8/2016 Yamada ..... G03G 15/2046
2018/0004135 A1* 1/2018 Sako ..... G03G 15/2042
(Continued)

FOREIGN PATENT DOCUMENTS

JP 2011253127 A * 12/2011
JP 2015036695 A * 2/2015
(Continued)

*Primary Examiner* — Carla J Therrien
(74) *Attorney, Agent, or Firm* — Canon U.S.A., Inc. I.P. Division

(57) ABSTRACT

An image forming apparatus includes an image forming unit configured to form an image based on image data, a fixing unit configured to fix the image formed by the image forming unit on a recording material, a conversion unit configured to convert image data into conversion data including a plurality of areas having a first resolution in a main scanning direction perpendicular to a conveyance direction of the recording material, and a second resolution higher than the first resolution in a sub-scanning direction, which is the conveyance direction of the recording material, an analysis unit configured to analyze values related to the areas of the plurality of areas of the conversion data obtained by the conversion unit, and a temperature control unit configured to control a fixing temperature of the fixing unit according to a result of the analysis performed by the analysis unit.

8 Claims, 12 Drawing Sheets

(56) References Cited

U.S. PATENT DOCUMENTS

| | | | | |
|---|---|---|---|---|
| 2019/0243292 | A1* | 8/2019 | Imaizumi | G03G 15/2039 |
| 2019/0317435 | A1* | 10/2019 | Yamashita | G03G 15/80 |
| 2020/0310310 | A1* | 10/2020 | Shinji | G03G 15/2039 |

FOREIGN PATENT DOCUMENTS

| | | | | |
|---|---|---|---|---|
| JP | 2015197653 | A * | 11/2015 | G03G 15/2039 |
| JP | 2016004231 | A * | 1/2016 | |

* cited by examiner

ABCDEFGHIJKL
OP
QRSTU
VXYZ-ABCDE

LOWER LIMIT
THRESHOLD VALUE W
NUMERICAL VALUE X
(PRINTING RATIO %)
10
20
30
40
50
60
70
80
90
100
5%
9%
7%
0%
0.05+0.09+0.07 = 0.21
2%
2%
2%
2%
2%
5%
4%
2%
0.05+0.04 = 0.09
1%
8%
7%
0.08+0.07 = 0.15
Y = 0.21

ABCDEFGHIJKL
OP
QRSTU
VXYZ-ABCDE

LOWER LIMIT THRESHOLD VALUE W
NUMERICAL VALUE X (PRINTING RATIO %)
10
20
30
40
50
60
70
80
90
100
|0-0.05| = 0.05
|0.05-0.09| = 0.04
|0.09-0.07| = 0.02
|0.07-0| = 0.07
|0-0| = 0
|0-0.02| = 0.02
|0.02-0.02| = 0
|0.02-0.02| = 0
|0-0.02| = 0.02
|0-0.02| = 0.02
|0.05-0.02| = 0.03
|0.04-0.05| = 0.01
|0.02-0.04| = 0.02
|0-0.02| = 0.02
|0-0.01| = 0.01
|0.08-0.01| = 0.07
|0.07-0.08| = 0.01
|0-0.07| = 0.07
SUM OF DIFFERENCES: 0.48
PRINTING RATIO D OF ENTIRE IMAGE AREA = 1.2%
PRINTING RATIO DIFFERENCE G: 0.48 ÷ 0.012 = 40

FIG.12 text only
text only
text only

IMAGE FORMING APPARATUS, IMAGE FORMING SYSTEM, AND IMAGE FORMING METHOD EACH CONTROLLING FIXING TEMPERATURE

CROSS-REFERENCE TO RELATED APPLICATIONS

This application is a continuation of U.S. patent application Ser. No. 16/388,514, filed on Apr. 18, 2019 and claims the benefit of Japanese Patent Application No. 2018-085294, filed on Apr. 26, 2018, both of which are incorporated herein by their entirety.

BACKGROUND

Field of the Disclosure

Aspects of the present disclosure generally relate to an image forming apparatus using an electrophotographic method.

Description of the Related Art

Heretofore, in image forming apparatuses, there has been a demand to appropriately control a fixing temperature depending on an image to be formed. Japanese Patent Application Laid-Open No. 2016-4231 discusses a method of controlling a fixing temperature according to the amount of toner calculated based on image data. Specifically, the method divides the entire region of image data into a plurality of areas each with a size of, for example, 32 dots by 32 dots, and controls the fixing temperature based on the amount of toner for an area to which the greatest amount of toner is allocated among all of the areas and the printing ratio of the entire image. In other words, if the greatest amount of toner is large, the method raises the fixing temperature to perform fixing, and, if the greatest amount of toner is small, the method lowers the fixing temperature to perform fixing.

Such a conventional method can be used to control the fixing temperature according to the printing ratio of an image to be formed. However, the conventional method performs control to analyze the entire region of image data and find an area to which the greatest amount of toner is allocated, and therefore, may need to have a configuration including, for example, a huge memory corresponding to image data and a central processing unit (CPU) which is high in processing speed for performing image analysis. As a result, the conventional method has an issue in the possibility of leading to an increase in cost.

SUMMARY

According to an aspect of the present disclosure, an image forming apparatus includes an image forming unit configured to form an image based on image data, a fixing unit configured to fix the image formed by the image forming unit on a recording material, a conversion unit configured to convert image data into conversion data including a plurality of areas having a first resolution in a main scanning direction perpendicular to a conveyance direction of the recording material, and a second resolution higher than the first resolution in a sub-scanning direction, which is the conveyance direction of the recording material, an analysis unit configured to analyze values related to the areas of the plurality of areas of the conversion data obtained by the conversion unit, and a temperature control unit configured to control a fixing temperature of the fixing unit according to a result of the analysis performed by the analysis unit.

Further features of the present disclosure will become apparent from the following description of exemplary embodiments with reference to the attached drawings.

BRIEF DESCRIPTION OF THE DRAWINGS

FIG. 12 is a diagram illustrating a text image.

DESCRIPTION OF THE EMBODIMENTS

Various exemplary embodiments, features, and aspects of the disclosure will be described in detail below with reference to the drawings. Furthermore, the following exemplary embodiments are not intended to limit the disclosure set forth in the claims, and not all of the combinations of characteristics described in the exemplary embodiments are necessarily essential for solutions in the disclosure.

[Description of Image Forming Apparatus]

Figure 1:
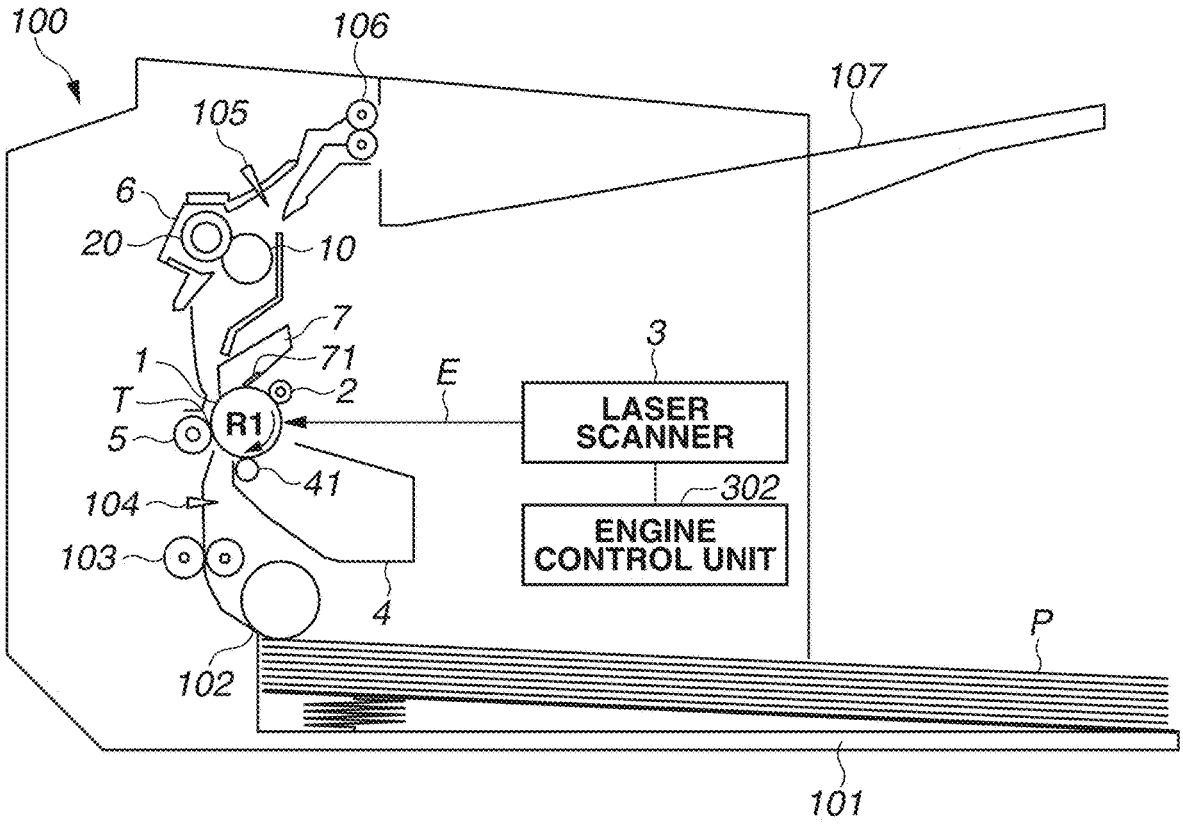
FIG. 1 is an outline configuration diagram of an image forming apparatus.

FIG. 1 is an outline configuration diagram of an image forming apparatus according to a first exemplary embodiment. Furthermore, while, here, an image forming apparatus for forming a monochroic image is described as an example, the image forming apparatus is not limited to this. For example, the first exemplary embodiment can also be applied to an image forming apparatus which forms a color image using the intermediate transfer method, which secondarily transfers, to a recording material, an image primarily transferred from a photosensitive drum to an intermediate transfer belt, and an image forming apparatus which forms a color image using the direct transfer method, which directly transfers an image from a photosensitive drum to a recording material.

A photosensitive drum 1 serving as a photosensitive member is a member composed by providing a photosensitive material, such as organic photo conductor (OPC), amorphous selenium, or amorphous silicon, on a drum base on a cylinder formed from aluminum alloy or nickel. The photosensitive drum 1 is driven to rotate by a motor serving as a drive unit (not illustrated) at a predetermined process speed (circumferential velocity) in the direction of arrow R1.

A charging roller 2 serving as a charging unit uniformly charges the surface of the photosensitive drum 1 to a predetermined polarity and potential. Scanning the charged surface of the photosensitive drum 1 with a laser beam E radiated from a laser scanner 3 serving as an exposure unit forms an electrostatic latent image on the photosensitive drum 1. The laser scanner 3 performs control to determine whether to radiate the laser beam E according to image information. Performing scanning with the laser beam E controlled in this way along the longitudinal direction of the photosensitive drum 1 forms an electrostatic latent image on the photosensitive drum 1.

The electrostatic latent image formed on the photosensitive drum 1 is developed with a developer (toner) by a developing device 4 serving as a developing unit, thus being made visible as an image. The developing method used for the developing device 4 includes, for example, a jumping developing method, a two-component developing method, and a contact developing method. Members for forming an image based on image data in the above-mentioned way can also be referred to as an "image forming unit".

An image on the photosensitive drum 1 developed by the developing device 4 is transferred to a recording material P. The recording material P is stacked on a paper feed tray 101, and is fed on a sheet-by-sheet basis by a paper feed roller 102. The fed recording material P is conveyed by a conveyance roller 103. The leading edge of the recording material P being conveyed is detected by a top sensor 104. The timing at which the leading edge of the recording material P arrives at a transfer nip portion T is determined based on the position of the top sensor 104, the position of the transfer nip portion T, and the conveyance speed of the recording material P. The image on the photosensitive drum 1 also moves to the transfer nip portion T according to the timing at which the recording material P arrives at the transfer nip portion T, and is then transferred onto the recording material P in response to a transfer bias being applied to a transfer roller 5 serving as a transfer unit.

The recording material P having the image transferred thereto is conveyed to a fixing device 6 serving as a fixing unit. The recording material P is then heated and pressed while being nipped and conveyed at a fixing nip portion between a heating member 10 and a pressure roller 20 in the fixing device 6, so that the image is fixed to the surface of the recording material P. The recording material P subjected to fixing is discharged by a discharge roller 106 onto a discharge tray 107, which is formed on the image forming apparatus 100. Furthermore, whether, for example, paper jam has occurred is monitored by a paper discharge sensor 105 detecting the timing at which the leading edge and trailing edge of the recording material P pass by. On the other hand, toner remaining on the photosensitive drum 1 without being transferred to the recording material P (transfer residual toner) is cleaned off by a cleaning blade 71 of a cleaning device 7 serving as a cleaning unit. After such a series of operations is performed, the image forming operation ends.

[Configuration of Control Unit]

Figure 2:
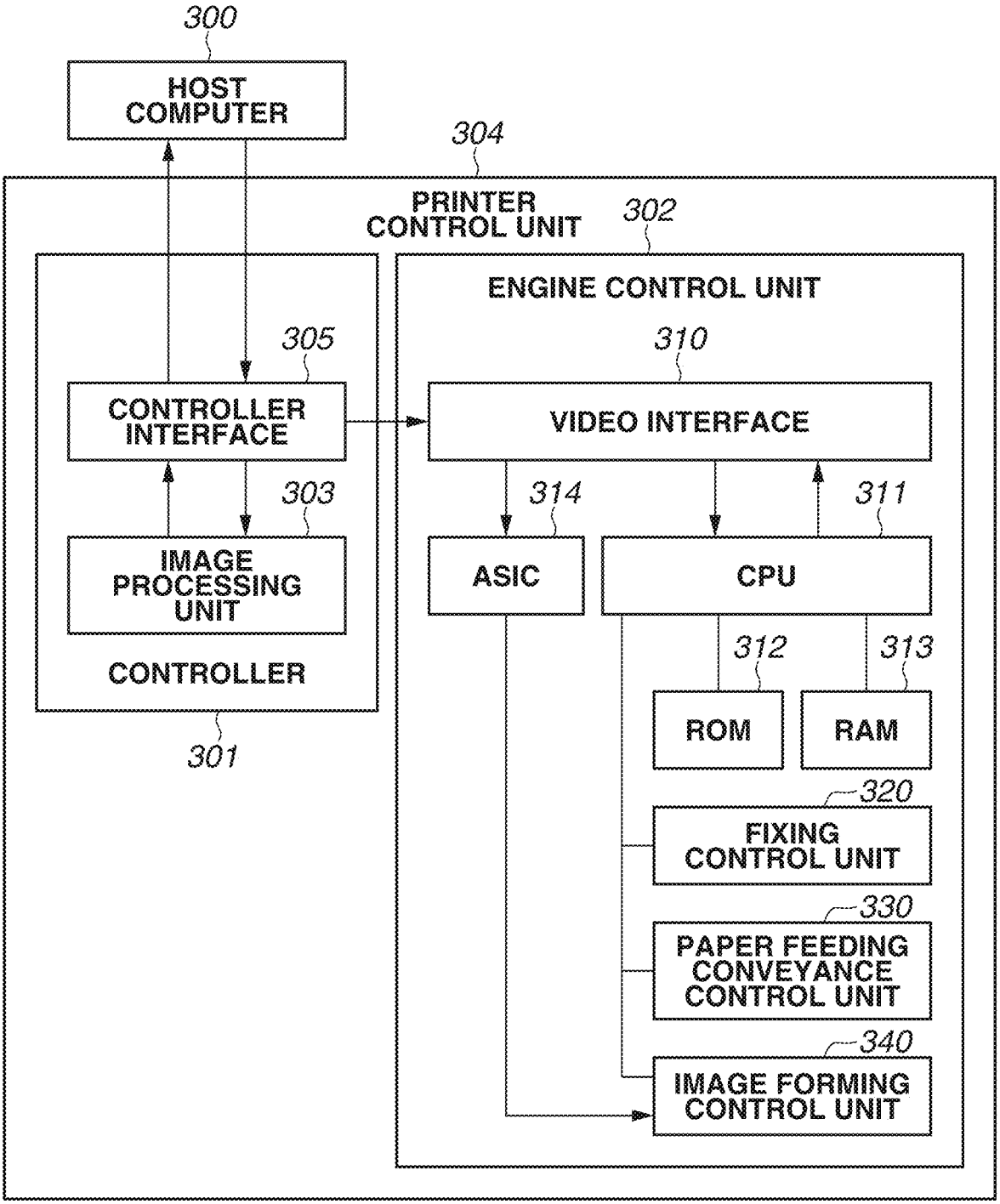
FIG. 2 is a block diagram illustrating, for example, a control unit of the image forming apparatus.

FIG. 2 is a block diagram illustrating, for example, a control unit of the image forming apparatus 100. A printer control unit 304 performs control over the image forming apparatus 100 with a controller 301 (first control unit) and an engine control unit 302 (second control unit). The controller 301 is connected to a host computer 300 via a controller interface 305, and thus performs communication therewith. The controller 301 performs, for example, bit-mapping of character code and halftoning processing of a gray scale image at an image processing unit 303 based on image data received from the host computer 300, thus generating image information. Then, the controller 301 transmits the generated image information to the engine control unit 302, which serves as a control unit, via a video interface 310 of the engine control unit 302. Thus, the controller 301 and the engine control unit 302 are able to communicate with each other via the video interface 310. The image information includes information for controlling a fixing temperature calculated by the image processing unit 303. Furthermore, a specific method of calculating information for controlling the fixing temperature is described below in detail.

An application specific integrated circuit (ASIC) 314, which is an integrated circuit for a specific application, in the engine control unit 302 performs a part of control operations related to image formation, such as light emission timing of the laser scanner 3. A central processing unit (CPU) 311, which is a central arithmetic processing device, in the engine control unit 302 performs a part of control operations related to image formation according to, for example, a printing mode or image size information. For example, the CPU 311 stores information in a random access memory (RAM) 313 as needed, uses a program stored in a read-only memory (ROM) 312 or the RAM 313, and refers to information stored in the ROM 312 or the RAM 313. With this, the CPU 311 performs control of the fixing temperature in the fixing device 6 at a fixing control unit 320, control of the paper feed speed and paper feed interval of the paper feed roller 102 at a paper feeding conveyance control unit 330, and control of the process speed, developing, charging, and transfer at an image forming control unit 340. Additionally, the controller 301 transmits, for example, a print instruction or a cancel instruction to the engine control unit 302 in response to an instruction issued by the user operating the host computer 300, thus also performing control of, for example, starting or ending of a printing operation.

[Fixing Device]

Figure 3:
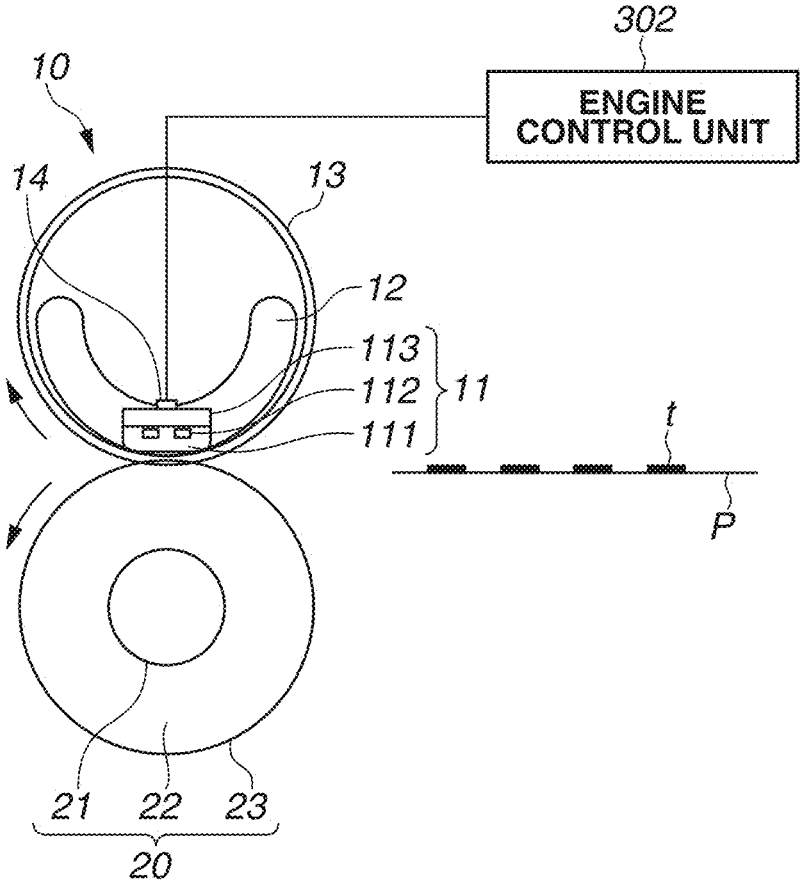
FIG. 3 is an outline configuration diagram illustrating a fixing device of the film heating type.

FIG. 3 is an outline configuration diagram illustrating the fixing device 6 of the film heating type. The fixing device 6 includes a film unit (heating member) 10, which performs heating, and a pressure roller 20, which performs application of pressure. The film unit 10 includes a heat-resistant film (fixing film) 13, which is a heating rotation member serving as a heat-transfer member, a heater 11, which is a heating member, and a heat-insulating stay holder 12, which is a heater holding member. Moreover, the pressure roller 20 is located at a position facing the film unit 10. A recording material P having an image "t" formed thereon is nipped and conveyed at a nip portion which is formed by the heater 11 and the pressure roller 20 via the fixing film 13. With this, heating and application of pressure are performed on the image "t", so that the image "t" is fixed to the recording material P.

A thermistor 14 serving as a temperature detection unit is located at a surface of the heater 11 opposite to the sliding surface thereof with the fixing film 13, so that the heater 11 is controlled by the engine control unit 302 in such a way as to become at a desired temperature. The heater 11 includes a resistance heating layer (heating element) 112 on a substrate (insulating substrate) 113, which is made from alumina or aluminum nitride as a ceramic. Then, the heater 11 is covered with an overcoat glass 111 for the purpose of insulation and abrasion resistance of the resistance heating layer 112, and is thus configured such that the overcoat glass 111 is in contact with the inner circumferential surface of the fixing film 13.

[Fixing Film]

The fixing film 13 is a composite layer film such as that described as follows. First, a thin metallic element tube made from, for example, stainless steel (SUS) or a high-temperature resin made from, for example, polyimide and a thermal conductive filler such as graphite are kneaded. Then, the surface of a base layer into which the kneaded materials are molded in a tubular shape is, directly or via a primer layer, coated with or covered in a tubular form with a releasable layer such as perfluoroalkoxy alkane (PFA), polytetrafluoroethylene (PTFE), or fluorinated ethylene propylene copolymer (FEP), so that a composite layer film is formed. The fixing film 13 used in the first exemplary embodiment is a film obtained by coating a base layer polyimide with PFA. The total film thickness thereof is 70 μm, and the outer circumferential length thereof is 56 mm.

Since the fixing film 13 rotates while frictionally sliding on the heater 11 and the heat-insulating stay holder 12, which are located inside the fixing film 13, it is necessary to reduce the frictional resistance between each of the heater 11 and the heat-insulating stay holder 12 and the fixing film 13 to a small value. Therefore, a small amount of lubricant such as high-temperature grease is applied onto the surfaces of the heater 11 and the heat-insulating stay holder 12. This enables the fixing film 13 to smoothly rotate.

[Pressure Roller]

The pressure roller 20 is configured by first forming an elastic layer 22, which is made by foaming heat-resisting rubber such as insulating silicone rubber or fluorine-contained rubber, on a metal core 21 made from, for example, iron and applying room temperature vulcanizing (RTV) silicone rubber, which has adhesiveness by being subjected to primer treatment, as an adhesion layer onto the elastic layer 22. Then, the pressure roller 20 is configured by forming a releasable layer 23 which is obtained by covering or coating the elastic layer 22 with a tube in which a conducting agent such as carbon is dispersed in, for example, PFA, PTFE, or FEP. The pressure roller 20 used in the first exemplary embodiment is a pressure roller with an outer diameter of 20 mm and a hardness of 48° (Asker-C under a weight of 600 g).

The pressure roller 20 is pressed by a pressure unit (not illustrated) at 15 Kg·f from both longitudinal end portions thereof so as to form a nip portion required for heating and fixing. Moreover, the pressure roller 20 is driven to rotate in the direction of an arrow illustrated in FIG. 3 (counterclockwise direction) by a rotation driving unit (not illustrated) from the longitudinal end portion thereof via the metal core 21. With this, the fixing film 13 is rotated following the pressure roller 20 in the direction of an arrow illustrated in FIG. 3 (clockwise direction) at the outer side of the heat-insulating stay holder 12.

[Heater]

The heater 11 is located inside the fixing film 13, and is configured by forming the resistance heating layer 112 on the substrate 113 and covering the resistance heating layer 112 with the thin-film overcoat glass 111. The overcoat glass 111 is excellent in withstanding voltage and abrasion resistance, and is configured to slide on the fixing film 13. The heater 11 used in the first exemplary embodiment is a heater with a thermal conductivity of 1.0 W/m·K, a withstanding voltage feature of 2.5 KV or more, and a film thickness of 70 μm. The substrate 113 of the heater 11 used in the first exemplary embodiment is made from alumina. The substrate 113 has a dimension of 6.0 mm in width, 260.0 mm in length, and 1.00 mm in thickness, and has a thermal expansion rate of $7.6\times10^{-6}$/° C. The resistance heating layer 112 used in the first exemplary embodiment is formed from a silver-palladium alloy, and has a total resistance value of 20Ω and a temperature dependency of resistivity of 700 ppm/° C.

[Holder]

The heat-insulating stay holder 12 not only holds the heater 11 but also prevents heat dissipation in the direction opposite to the nip portion, and is formed from, for example, a crystal polymer, a phenolic resin, polyphenylene sulfide (PPS), or polyetheretherketone (PEEK). Then, the fixing film 13 is loosely fitted onto the heat-insulating stay holder 12, and is located in such a way as to be freely rotatable. The heat-insulating stay holder 12 used in the first exemplary embodiment is a holder made from a crystal polymer and having a heat resistance of 260° C. and a thermal expansion rate of $6.4\times10^{-5}$/° C.

[Fixing Control Unit]

The fixing control unit 320 has a fixing temperature control program, and controls the temperature of the heater 11 to a predetermined fixing temperature based on the temperature detected by the thermistor 14. As the method of controlling the fixing temperature, proportional-integral-derivative (PID) control using the following formula (1) composed of a proportional term, an integral term, and a derivative term is favorable.

$$f(t)=\alpha1\times e(t)+\alpha2\times\Sigma e(t)+\alpha3\times(e(t)-e(t-1)) \quad (1)$$

t: control timing, f(t): a heater energization time rate in a control cycle at timing t (full energization when the value is 1 or more), e(t): a temperature difference between the target temperature and the actual temperature at the current timing t, e(t−1): a temperature difference between the target temperature and the actual temperature at the preceding timing t−1, α1: a P (proportional) term gain, α2: an I (integral) term gain, and α3: a D (derivative) term gain.

The first term to the third term on the right-hand side of formula (1) respectively correspond to proportional control, integral control, and derivative control. Here, α1 to α3 are proportionality coefficients for performing weighting on the amounts of increase and decrease of the heater energization time rate in the control cycle. Appropriately setting α1 to α3 according to the characteristics of the fixing device 6 enables performing optimum temperature control.

The method determines a heater energization time in the control cycle according to the value of f(t), and drives a heater energization time control circuit (not illustrated) to determine heater output power. Moreover, if the D term is not necessary, the D term gain can be set to 0, so that PI control, in which only the P term and the I term function, can be used to perform temperature control. In the first exemplary embodiment, the control timing was updated at intervals of 100 msec, which was the control cycle, and the P term gain (α1) was set to 0.05° $C.^{-1}$, the I term gain (α2) was set to 0.01° $C.^{-1}$, and the D term gain (α3) was set to 0.001° $C.^{-1}$. In a case where the value of f(t) was 1, the energization time in the control cycle was set in such a way as to become maximum, and in a case where the value of f(t) was greater than 1, energization was set in such a way as to be performed for the maximum energization time in the control cycle.

Figure 4:
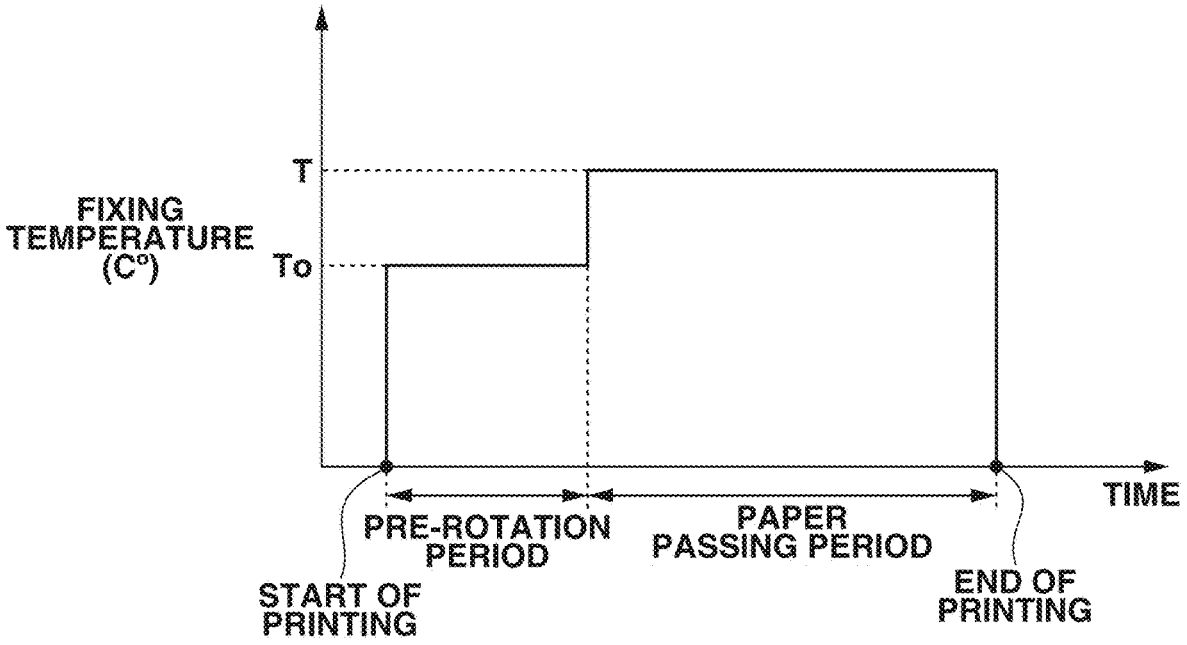
FIG. 4 is a diagram illustrating an example of a case where the fixing temperature is controlled.

FIG. 4 is a diagram illustrating an example of a case where the above-mentioned control of the fixing temperature is performed. A temperature control sequence is performed according to an operation of the image forming apparatus. As illustrated in FIG. 4, in a pre-rotation period, which is a period after the image forming operation starts until the leading edge of the recording material P enters the fixing nip portion, the fixing temperature To (° C.) is set to 180° C. Moreover, in a paper passing period, which is a period after the leading edge of the recording material P enters the fixing nip portion until the trailing edge of the recording material P exits the fixing nip portion, the fixing temperature T (° C.) is set to 190° C. While, here, as an example, the fixing temperature T (° C.) is set to 190° C., the fixing temperature T (° C.) is set in the range of 190° C. to 210° C. The method of calculating the fixing temperature T (° C.) is described below in detail.

[Method of Calculating Fixing Temperature]

Besides, for example, halftoning processing of a gray scale image, the image processing unit 303 also performs processing for calculating the fixing temperature from image information. Hereinafter, a specific method of calculating the fixing temperature is described. First, in the present exemplary embodiment, the image processing unit 303 serving as a conversion unit calculates a printing ratio from image information. In that process, the image processing unit 303 calculates a printing ratio with "the entire region in the main scanning direction×2 mm in the sub-scanning direction" used as one area. In other words, the image processing unit 303 calculates a printing ratio based on conversion data which is obtained by converting image data into data divided into areas having a first resolution in the main scanning direction and a second resolution higher than the first resolution in the sub-scanning direction. However, the method of dividing image data into areas is not limited to this, but image data can be divided into a plurality of areas in the main scanning direction, or a range longer than 2 mm in the sub-scanning direction can be set as one area. The method of division into areas can be set as appropriate in view of, for example, the accuracy of a fixing temperature desired to be controlled, the time required for control, or the processing capability of the printer control unit 304. Furthermore, the main scanning direction is a direction perpendicular to the conveyance direction of a recording material, and the sub-scanning direction can be said to be the conveyance direction of a recording material.

Figure 5:
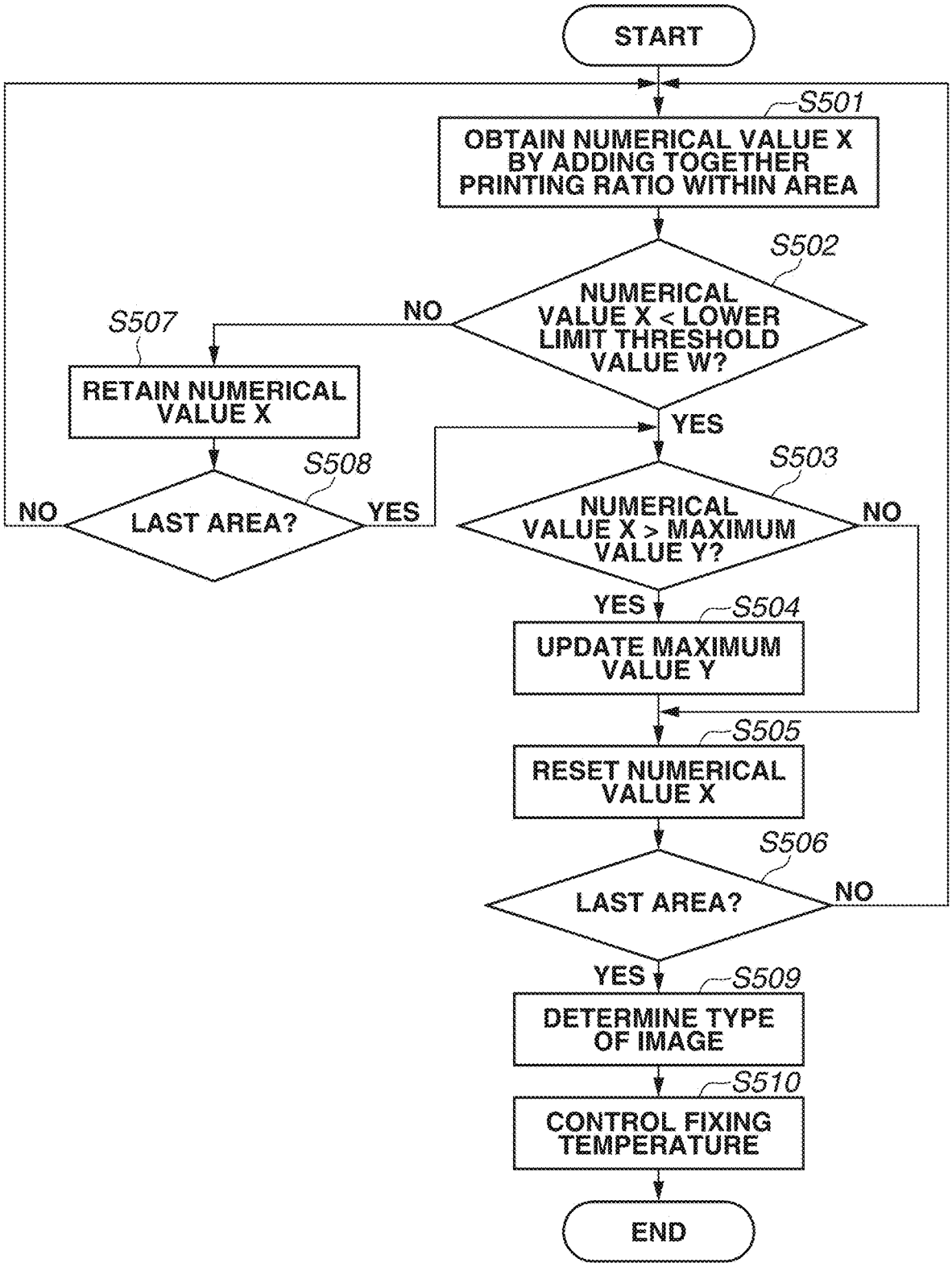
FIG. 5 is a flowchart illustrating a method of controlling the fixing temperature.

FIG. 5 is a flowchart illustrating a method of controlling the fixing temperature. In step S501, the image processing unit 303 serving as a conversion unit obtains a numerical value X by adding together printing ratios within a single area. In step S502, the image processing unit 303 serving as an analysis unit determines whether the obtained numerical value X is smaller than a lower limit threshold value W, which is a first threshold value. The lower limit threshold value W is a value used for detecting the presence or absence of an image interval (a space between images) in the sub-scanning direction in an image to be formed on a single sheet of recording material P. In other words, the lower limit threshold value W can be said to be a value used for recognizing a space between lines in a text image. In a case where the numerical value X, which is a value obtained by adding together printing ratios within a single area, falls below the lower limit threshold value W, depending on the setting of the lower limit threshold value W, it can be determined that very little of the image is formed on that area. In other words, it can be recognized that there is a space between lines in the text image.

On the other hand, if the lower limit threshold value W is set to 0, an image of one dot (a narrow vertical band) formed within a single area may result in it being impossible to recognize that there is a space between lines. Conversely, if the lower limit threshold value W is set to a large value, even in a case where, for example, a somewhat thick image (a wide vertical band) is formed within one area and it is not desired to determine that there is a space between lines, it may be recognized, erroneously, that there is a space between lines. Such a recognition may cause the possibility of excessively raising or lowering the fixing temperature more than necessary. In the fixing device 6 in the first exemplary embodiment, if a vertical band with a width of 8 mm or less is formed, even when the fixing temperature to be described below is lowered to 190° C., fixing is able to be performed with fixability ensured. Therefore, in a specific example in the first exemplary embodiment, in a case where the size of one area was set to 200 mm in length in the main scanning direction×2 mm in length in the sub-scanning direction, the lower limit threshold value W was set to 0.04 (4%). The lower limit threshold value W can be set as appropriate according to, for example, the performance of the fixing device 6 or the size of one area.

If, in step S502, it is determined that the numerical value X is smaller than the lower limit threshold value W (YES in step S502), the processing proceeds to step S503, and, if it is determined that the numerical value X is larger than or equal to the lower limit threshold value W (NO in step S502), the processing proceeds to step S507. In step S503, the image processing unit 303 determines whether the numerical value X is larger than a maximum value Y. If it is determined that the numerical value X is larger than the maximum value Y (YES in step S503), the processing proceeds to step S504, and, if it is determined that the numerical value X is smaller than or equal to the maximum value Y (smaller than or equal to the maximum value up to this point) (NO in step S503), the processing proceeds to step S505. In step S504, the image processing unit 303 updates the maximum value Y with the numerical value X. In step S505, the image processing unit 303 resets the numerical value X. Furthermore, while, here, as an example, if the numerical value X in one area is smaller than the lower limit threshold value W, the image processing unit 303 resets the numerical value X, the first exemplary embodiment is not limited to this. For example, control can be performed such that, if a numerical value X obtained by adding together printing ratios in two areas is smaller than the lower limit threshold value W, the image processing unit 303 resets the numerical value X. In step S506, the image processing unit 303 determines whether the current area from which to calculate printing ratios is the last area. If it is determined that the current area is not the last area (NO in step S506), the processing returns to step S501, in which the image processing unit 303 repeats the processing, and, if it is determined that the current area is the last area (YES in step S506), the processing proceeds to step S509.

If, in step S502, it is determined that the numerical value X is larger than or equal to the lower limit threshold value W (larger than or equal to a first threshold value) (NO in step S502), then in step S507, the image processing unit 303 retains the numerical value X without resetting the numerical value X. In step S508, the image processing unit 303 determines whether the current area from which to calculate printing ratios is the last area. If it is determined that the current area is not the last area (NO in step S508), while the numerical value X is retained, the processing returns to step S501, in which the image processing unit 303 adds together printing ratios within the next area and adds that value to the retained value of X retained in step S507. If it is determined that the current area is the last area (YES in step S508), the processing proceeds to step S503, in which the image processing unit 303 makes a comparison between the numerical value X and the maximum value Y.

In step S509, the image processing unit 303 serving as an analysis unit determines the type of an image based on the calculated maximum value Y. Specifically, the image processing unit 303 determines the type of an image by making a comparison between the maximum value Y and an upper limit threshold value Z, which is a second threshold value. If the maximum value Y is smaller than or equal to the upper limit threshold value Z (smaller than or equal to the second threshold value), the image processing unit 303 determines that the image is a pattern A, and, if the maximum value Y is larger than the upper limit threshold value Z, the image processing unit 303 determines that the image is a pattern B. Thus, the image processing unit 303 is able to discriminate the type of an image by analyzing numerical values that are based on the numerical value X obtained by converting image data. Furthermore, here, as an example, for ease of explanation, the method of dividing images into two patterns is described. However, the first exemplary embodiment is not limited to this, but the types of images can be divided into two or more patterns so as to more finely control the fixing temperature.

The upper limit threshold value Z serves as a value used for determining whether a high-density region is present in an image to be formed on one sheet of recording material P. If the maximum value Y is smaller than or equal to the upper limit threshold value Z, the image processing unit 303 can determine that a high-density region, in which to perform fixing with the raised fixing temperature, is not present in the entire image area. If the maximum value Y is larger than the upper limit threshold value Z, the image processing unit 303 can determine that a high-density region, in which to perform fixing with the raised fixing temperature, is present in the entire image area. In this way, the image processing unit 303 is able to determine whether a high-density region is present by determining the type of an image with use of the upper limit threshold value Z, thus appropriately controlling the fixing temperature. Furthermore, in the first exemplary embodiment, since, in a usual text image, the maximum value Y does not exceed 0.3, the upper limit threshold value Z was set to 0.3. The upper limit threshold value Z can be set as appropriate according to, for example, the performance of the fixing device 6 or the size of one area.

In step S510, the engine control unit 302 serving as a temperature control unit controls the fixing temperature according to the type of an image obtained as a result of analysis. Specifically, the engine control unit 302 performs control based on a temperature control table shown in the following table (1) in such a manner that, if the image is the pattern A, the fixing temperature is set to 190° C. and, if the image is the pattern B, the fixing temperature is set to 210° C.

TABLE (1)

| Temperature control table | |
|---|---|
| | Fixing temperature T ° C. |
| Pattern A | 190 |
| Pattern B | 210 |

Performing the method of controlling the fixing temperature in the above-described way enables appropriately controlling the fixing temperature according to the type of an image. For example, control can be performed such that, in the case of an easy-to-fix image (pattern A), which can be determined to be mainly composed of text easy to fix, the fixing temperature is set low, and, in the case of a difficult-to-fix image (pattern B), which can be determined to include, for example, a vertical band or a high-density region difficult to fix, the fixing temperature is set high.

Furthermore, while, here, as an example, the method in which steps S501 to S509 are performed by the image processing unit 303 and step S510 is performed by the engine control unit 302 has been described, the first exemplary embodiment is not limited to this. For example, processing in step S501 can be performed by the image processing unit 303 and processing in steps S502 to S510 can be performed by the engine control unit 302. In this case, since the image processing unit 303 only needs to transmit not image data itself but the numerical value X obtained by conversion in each area to the engine control unit 302, there is also such an advantageous effect that the communication volume can be reduced. Moreover, image data itself can be transmitted from the image processing unit 303 to the engine control unit 302 and processing in steps S501 to S510 can be performed by the engine control unit 302. Moreover, processing in steps S501 to S509 can be performed by a server connected to the image forming apparatus via a network. Thus, an image forming system or an image forming method for performing the above-described processing can be attained.

Figures 6A, 6B:
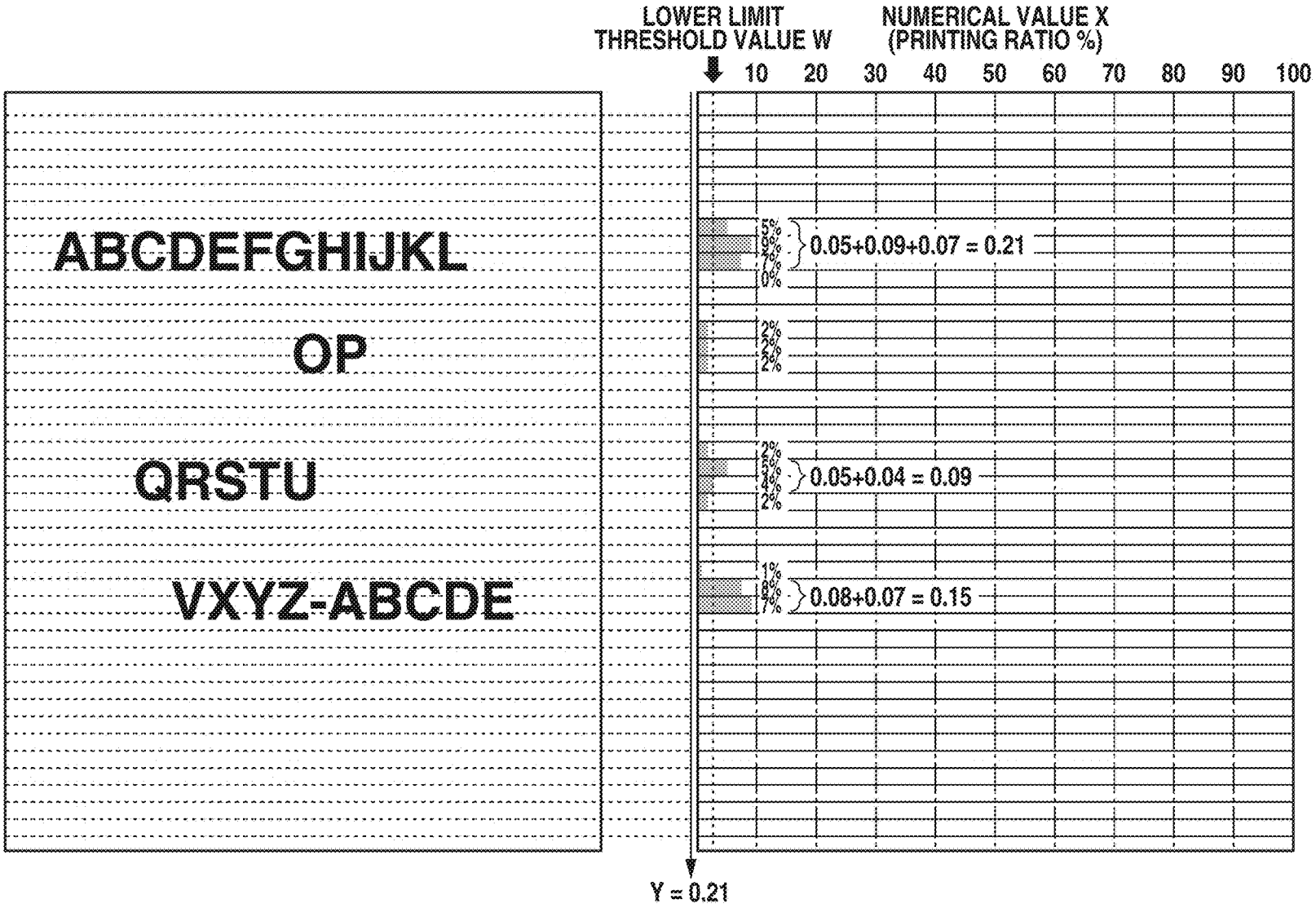
FIGS. 6A and 6B are diagrams illustrating a result of the method of controlling the fixing temperature being performed.

FIGS. 6A and 6B and FIGS. 7A and 7B are diagrams illustrating results obtained by performing the method of controlling the fixing temperature in the first exemplary embodiment with respect to respective images as examples. FIG. 6A illustrates an image to be formed on a recording material P. Here, an image in which text is formed is illustrated as an example. FIG. 6B illustrates specific numerical values obtained in a case where the method of controlling the fixing temperature in the first exemplary embodiment has been performed.

FIG. 6A illustrates an image mainly composed of text, which does not include any image, such as a vertical band, in which the areas including the image are contiguous in the sub-scanning direction. From FIG. 6B, it is also understood that there are many areas in which the numerical value X obtained by adding together printing ratios in one area is smaller than the lower limit threshold value W. Specifically, referring to FIG. 6A, for example, in each of the areas in which letters A to L of the alphabet are formed, the numerical value X in one area is larger than the lower limit threshold value W. The numerical values X in the respective areas are the values of 0.05, 0.09, and 0.07, and the numerical value X obtained by summing the numerical values in the three areas becomes 0.21. Since, when processing is performed in the entire image area, the obtained numerical value X (0.21) becomes the largest value, the maximum value Y also becomes 0.21. Since the maximum value Y is smaller than the upper limit threshold value Z (0.30), the image illustrated in FIG. 6A can be determined to be the pattern A, which has characteristics of text, so that the fixing temperature can be controlled to be set to 190° C.

Figure 7A:
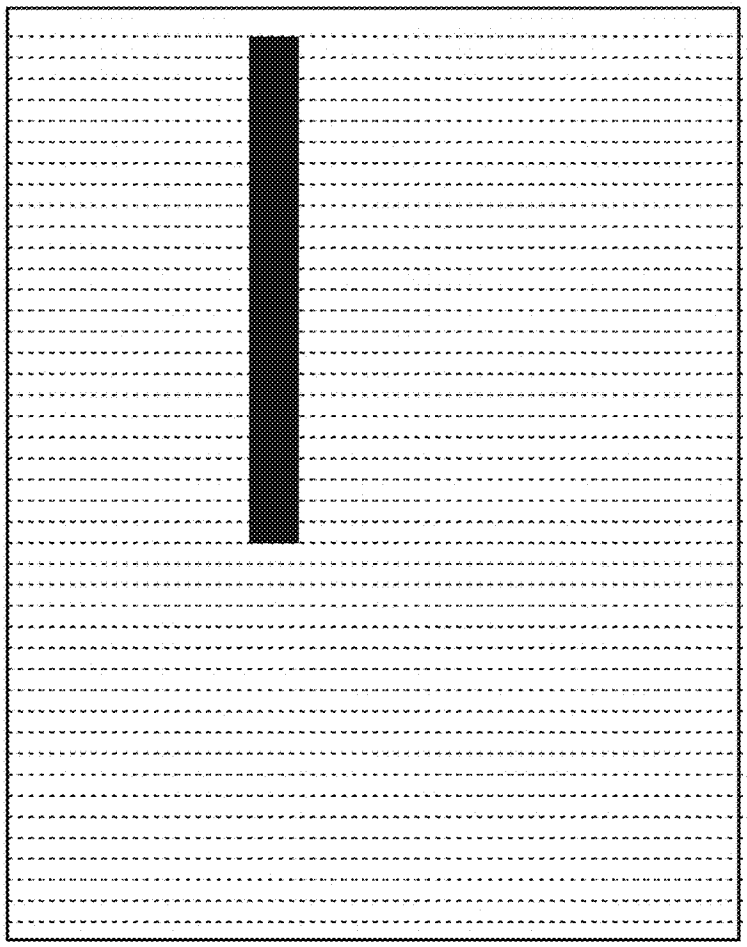
FIGS. 7A and 7B are diagrams illustrating a result of the method of controlling the fixing temperature being performed.
Figure 7B:
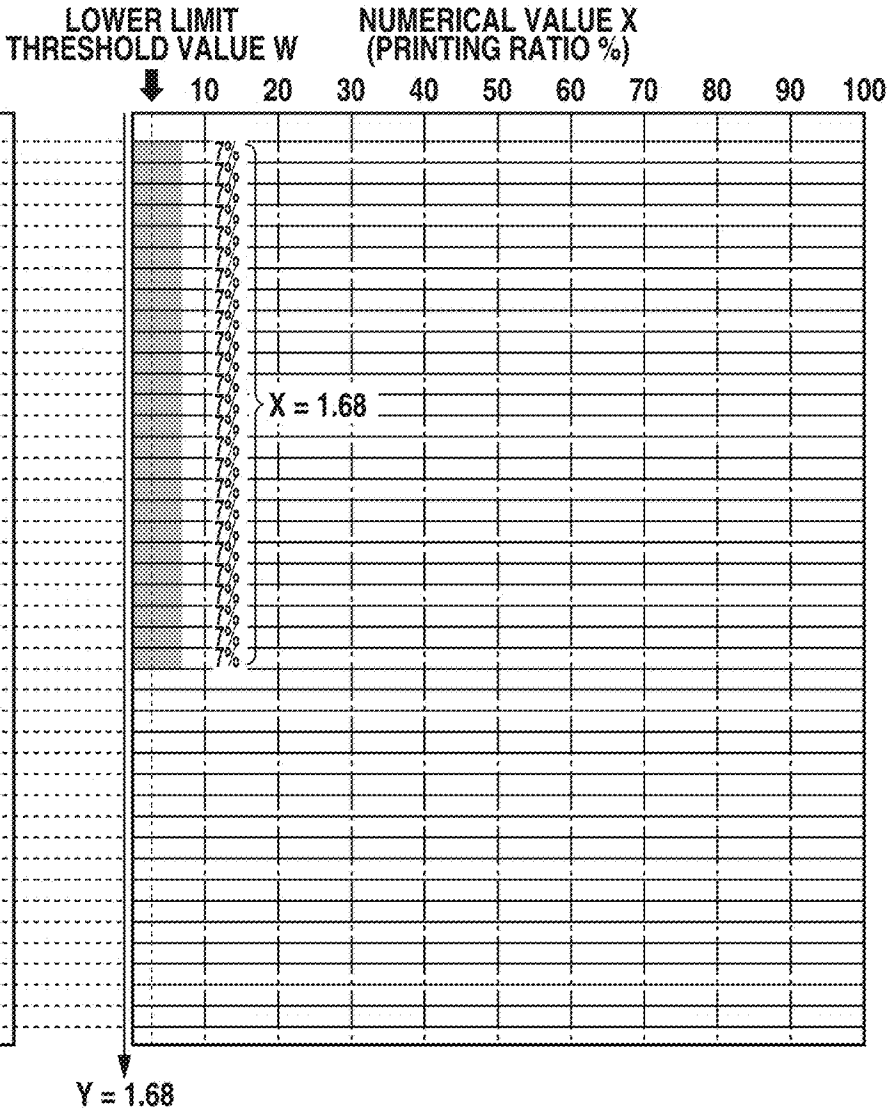

FIG. 7A illustrates an example of an image to be formed on a recording material P. Here, an image in which a vertical band in which images are contiguous in the sub-scanning direction is formed is illustrated as an example. FIG. 7B illustrates specific numerical values obtained in a case where the method of controlling the fixing temperature in the first exemplary embodiment has been performed.

The image illustrated in FIG. 7A includes an image, such as a vertical band, in which the areas including parts of the vertical band are contiguous in the sub-scanning direction. Since the printing ratio of each of the areas including part of the vertical band is larger than the lower limit threshold value W and are contiguous in the sub-scanning direction, referring to FIG. 7B, it is understood that the numerical values X increase in value due to the printing ratios being added together in each iteration. Specifically, referring to FIG. 7A, images in which the numerical value X in each area is 0.07 (the printing ratio being 7%) are contiguous for 24 areas. Therefore, the numerical value X obtained by summing the numerical values in 24 areas becomes 0.07×24=1.68. Since, when processing is performed in the entire image area, the obtained numerical value X (1.68) becomes the largest value, the maximum value Y also becomes 1.68. Since the maximum value Y is larger than the upper limit threshold value Z (0.30), the image illustrated in FIG. 7A can be determined to be the pattern B, so that the fixing temperature can be controlled to be set to 210° C.

Figure 8:
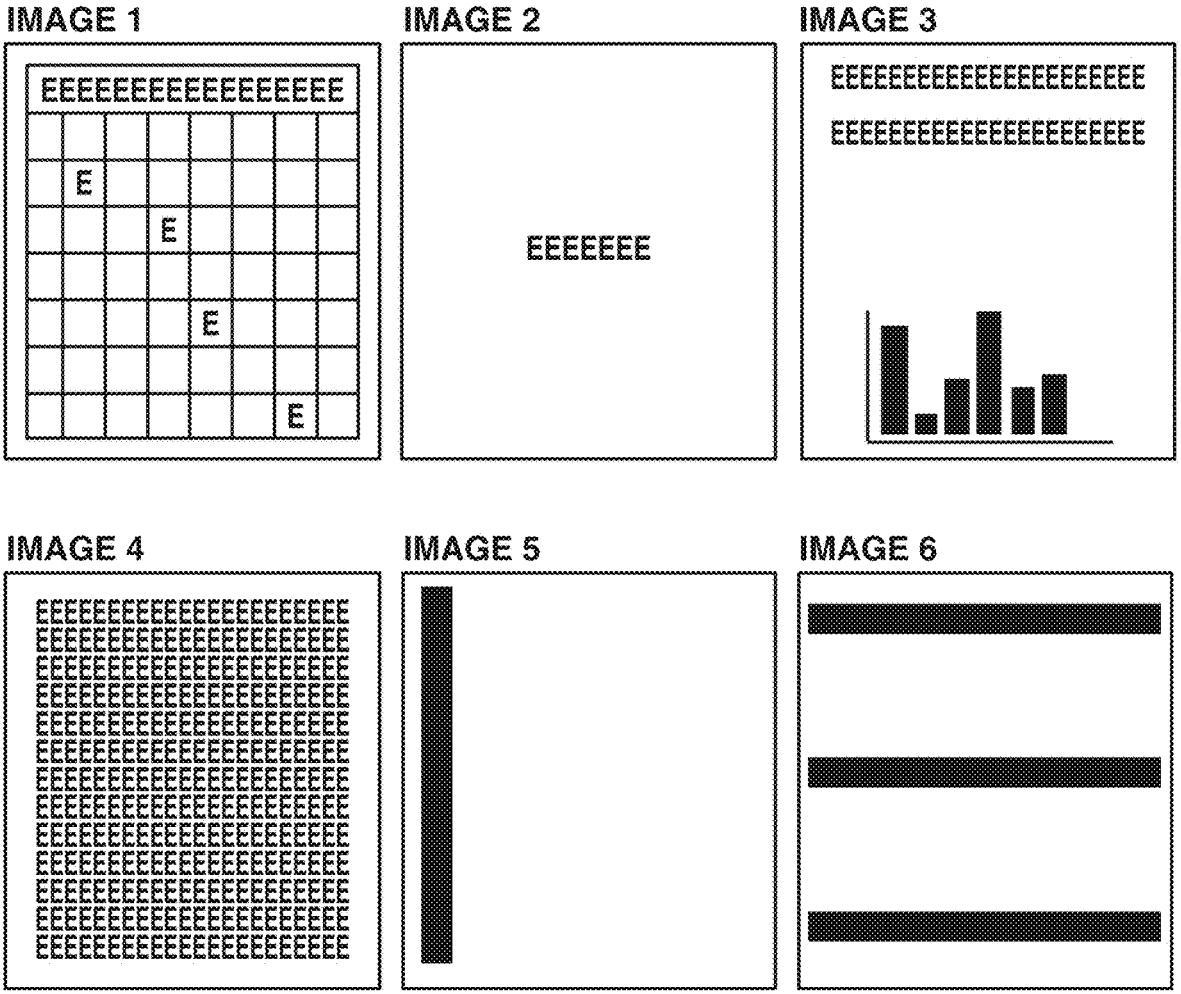
FIG. 8 is a diagram illustrating examples of images having various patterns formed on recording materials, including an image 1 to an image 6.

FIG. 8 illustrates examples of images having various patterns formed on recording materials P, including an image 1 to an image 6. Results obtained by performing the method of controlling the fixing temperature in the first exemplary embodiment on these images are shown in Table (2).

TABLE (2)

| Image types in first exemplary embodiment | | |
|---|---|---|
| | First exemplary embodiment | |
| | Maximum value Y (upper limit threshold value Z: 0.3) | Image type |
| Image 1 | 0.20 | Pattern A |
| Image 2 | 0.05 | Pattern A |
| Image 3 | 1.2 | Pattern B |
| Image 4 | 0.25 | Pattern A |
| Image 5 | 9.8 | Pattern B |
| Image 6 | 19.8 | Pattern B |

The image 1 represents an image in which a lattice is formed over the entire image area and text is partially formed. In such an image, since the numerical value X obtained by summing the printing ratios in one area becomes smaller than the lower limit threshold value W, the numerical value X is frequently reset. Therefore, since the maximum value Y, being 0.20, becomes smaller than the upper limit threshold value Z (0.30), the image 1 can be discriminated to be the pattern A.

The image 2 represents an image in which text is formed at a part of the central portion of the image and the printing ratio is low throughout the entire image area. In such an image, since the numerical value X obtained by summing the printing ratios in one area also becomes smaller than the lower limit threshold value W, the numerical value X is frequently reset. Therefore, since the maximum value Y, being 0.05, becomes smaller than the upper limit threshold value Z (0.30), the image 2 can be discriminated to be the pattern A.

The image 3 represents an image in which, although the printing ratio of the entire image is low, the printing ratio of a trailing edge portion in the sub-scanning direction is high. In such an image, although the numerical value X in a leading edge portion in the sub-scanning direction becomes low, the numerical value X in the trailing edge portion becomes large due to the printing ratios for a plurality of areas going on being summed Since the maximum value Y, being 1.2, becomes larger than the upper limit threshold value Z (0.30), the image 3 can be discriminated to be the pattern B.

The image 4 represents an image in which text is formed throughout the entire image area. In such an image, the numerical value X is frequently reset in spaces between text lines. Therefore, since the maximum value Y, being 0.25, becomes smaller than the upper limit threshold value Z (0.30), the image 4 can be discriminated to be the pattern A.

The image 5 represents an image in which, although the printing ratio of the entire image is low, images called a vertical band are contiguous in the sub-scanning direction. In such an image, since the numerical value X becomes larger than the lower limit threshold value W in a plurality of areas, the numerical value X becomes large because of going on being summed without being reset. Therefore, since the maximum value Y, being 9.8, becomes larger than the upper limit threshold value Z (0.30), the image 5 can be discriminated to be the pattern B.

The image 6 represents an image in which images contiguous in the main scanning direction are formed at the leading edge portion, the central portion, and the trailing edge portion in the sub-scanning direction. In such an image, the numerical value X in one area becomes large due to images contiguous in the main scanning direction being formed. Therefore, since the maximum value Y, being 19.8, becomes larger than the upper limit threshold value Z (0.30), the image 6 can be discriminated to be the pattern B.

[Evaluation Method for Fixability]

Next, an evaluation method for fixability is described. Under the environment of 25° C. in air temperature and 50% in humidity, image formation of each of the images 1 to 6 illustrated in FIG. 8 was performed continuously for 100 sheets, and the evaluation of fixability and electric power measured on that occasion was conducted. The recording material P for use in the evaluation method was CANON Red Label 80 g/cm$^2$ (size A4). The evaluation of fixability was conducted with visual observation. The rough standard for the evaluation of fixability is as follows.

"AA": No image defect caused by faulty fixing is observed, so that the image quality is satisfied.

"BB": Although white spots caused by faulty fixing are slightly observed, the image quality is satisfied.

"CC": White spots caused by faulty fixing are considerably observed. Moreover, toner partially adheres to a fixing film and contamination by toner occurs in the trailing edge portion of a recording material P, so that the image quality is not satisfied.

Furthermore, with regard to the measurement of electric power, an electric power meter (Digital Power Meter WT310, manufactured by Yokogawa Test & Measurement Corporation) was connected in series to a fixing heater and electric power was measured after image formation of each of the images 1 to 6 was performed continuously for 100 sheets. Moreover, for comparison with the control method in the first exemplary embodiment, the evaluation of fixability was also similarly conducted with respect to the following comparative example 1 and comparative example 2.

Comparative Example 1

The fixing temperature is controlled in such a way as to be able to perform fixing while satisfying the image quality with respect to whatever type of image even when the most high-density image is formed. Specifically, the fixing temperature is not changed according to images, but is uniformly set to 210° C.

Comparative Example 2

Control is performed in such a manner that, according to information about the printing ratio of an image to be formed, the fixing temperature is lowered with respect to an image with a low printing ratio and the fixing temperature is raised with respect to an image with a high printing ratio. Specifically, the image resolution is set to 12 dpi in the vertical direction and to 12 dpi in the horizontal direction. About 2 mm×2 mm becomes equivalent to one pixel. Then, pixels with a printing ratio of 30% or more are counted, and the printing ratio (P %) is calculated by dividing the number of counted pixels by the number of all of the pixels. The fixing temperature is controlled according to a temperature control table shown in Table (3) based on the calculated printing ratio (P %). The temperature control table shown in Table (3) is set in such a manner that the relationship between the printing ratio and the fixing temperature becomes linear.

TABLE (3)

Temperature control table

| Printing ratio (P %) | Fixing temperature T ° C. |
|---|---|
| 0 | 190 |
| 10 | 192 |
| 20 | 194 |
| 30 | 196 |
| 40 | 198 |
| 50 | 200 |
| 80 | 206 |
| 100 | 210 |

[Result of Study of Fixability]

Fixability in each of the first exemplary embodiment, the comparative example 1, and the comparative example 2 is shown in Table (4).

TABLE (4)

Result of study of fixability

| | | Images | | | | | |
|---|---|---|---|---|---|---|---|
| | | 1 | 2 | 3 | 4 | 5 | 6 |
| First exemplary embodiment | Fixability | AA | AA | AA | AA | AA | AA |
| | Fixing temperature (° C.) | 190 | 190 | 210 | 190 | 210 | 210 |
| | Electric power (Wh) | 25.8 | 25.8 | 27.7 | 25.8 | 27.7 | 27.7 |
| Comparative example 1 | Fixability | AA | AA | AA | AA | AA | AA |
| | Fixing temperature (° C.) | 210 | 210 | 210 | 210 | 210 | 210 |
| | Electric power (Wh) | 27.7 | 27.7 | 27.7 | 27.7 | 27.7 | 27.7 |
| Comparative example 2 | Fixability | AA | AA | BB | AA | CC | AA |
| | Fixing temperature (° C.) | 192 | 190 | 194 | 194 | 196 | 210 |
| | Electric power (Wh) | 26.0 | 25.8 | 26.2 | 26.2 | 26.4 | 27.7 |

As can be understood from the above table (4), performing the method of controlling the fixing temperature in the first exemplary embodiment makes fixability good in all of the images, i.e., the image 1 to the image 6. Additionally, since it can be appropriately determined that, depending on the type of an image, fixability is able to be satisfied even when the fixing temperature is lowered, power consumption can be reduced to a low value with respect to, for example, the images 1, 2, and 4.

For example, the comparative example 1 sets the fixing temperature to 210° C. with respect to all of the images, i.e., the image 1 to the image 6, and is, therefore, able to satisfy fixability. However, since the comparative example 1 unfavorably applies the excessive fixing temperature to, for example, the images 1, 2, and 4, it can be understood that power consumption becomes larger than in the first exemplary embodiment. Moreover, the comparative example 2 controls the fixing temperature according to the respective printing ratios of the image 1 to the image 6. However, if the fixing temperature is simply controlled according to the printing ratio, it is not possible to deal with an image which, although having a low printing ratio, requires a high fixing temperature due to contiguous images, such as the image 3 or the image 5. Therefore, it becomes impossible to satisfy fixability with respect to the image 3 and the image 5.

In the above-described way, the method of controlling the fixing temperature in the first exemplary embodiment is able to appropriately control the fixing temperature by analyzing the printing ratio of an image to be formed and discriminating the type of the image. For example, in a method of controlling the fixing temperature according to the printing ratio of an image to be formed, depending on the type of the image, a difference may in some cases occur between the fixing temperature to be set and an optimum fixing temperature. Usually, in a case where a high-density region is present in the image area, a large quantity of heat is drawn from the fixing device 6 during fixing of a recording material P. Additionally, with regard to an image, such as a vertical band, in which high-density regions are contiguous in the sub-scanning direction, since heat is continuously drawn from a specific portion of the heating member (film unit) 10, even when the printing ratio of the entire image is low, a high fixing temperature becomes required. Using the method of controlling the fixing temperature in the first exemplary embodiment enables appropriately controlling the fixing temperature even in such a situation.

Moreover, for example, in the case of an image composed of text, heat is unlikely to be drawn from the heating member 10. Usually, a text image has spaces between lines in many cases, so that a line on which an image is formed and a line in which no image is formed may be present in the sub-scanning direction. With respect to a text image having such features, heat is not continuously drawn from the heating member 10 as compared with an image such as a vertical band in which images are contiguous. Therefore, as compared with an image such as a vertical band having the same printing ratio, even when the fixing temperature is lowered, fixability can be ensured. Although, even if the fixing temperature is simply controlled according to the printing ratio, it is impossible to appropriately control the fixing temperature in the above-described way according to the type of an image, using the method of controlling the fixing temperature in the first exemplary embodiment makes it possible to appropriately control the fixing temperature in such a situation. In other words, even when the fixing temperature is lowered according to the type of an image, it is possible to satisfy fixability and it is also possible to reduce power consumption to a low value.

Moreover, in order to control the fixing temperature according to the type of an image, a method of finely dividing image data into areas in the main scanning direction and sub-scanning direction and recognizing the printing ratio of each of the areas can be conceived. However, as image data is more finely divided into areas, the image processing unit 303 requires a larger memory, so that the processing time required for image analysis by the image processing unit 303 may also become longer. Therefore, depending on the performance of a memory or an integrated circuit (IC), this may cause the first print output time (FPOT) to become delayed or may cause the reliability of a processing operation for image analysis to decrease.

In an image forming apparatus of the electrophotographic type, image data is read with respect to the main scanning direction, which is perpendicular to the sub-scanning direction serving as the conveyance direction of a recording material P, the read image data is converted into data about, for example, a pulse width so as to perform exposure with laser, and the converted data is sequentially sent to the laser scanner 3. Therefore, even in a case where image processing is performed by the image processing unit 303 so as to control the fixing temperature, image analysis processing is performed, with use of the image data read in the main scanning direction, in common with processing for sending the converted data to the laser scanner 3, so that the use of a memory can be made more efficient. Additionally, the processing time for image analysis can also be shortened.

Accordingly, in the first exemplary embodiment, the printing ratio is calculated, for example, with "the entire region in the main scanning direction×2 mm in the sub-scanning direction" set as one area. Even when image data is not finely divided into areas, conceiving a technique such as the method of controlling the fixing temperature in the first exemplary embodiment enables discriminating the type of an image based on an increase or decrease in printing ratio between areas in the sub-scanning direction. Thus, it is possible to prevent or reduce an increase in cost of a configuration required for controlling the fixing temperature, such as a memory or a CPU. Performing fixing at an appropriate fixing temperature corresponding to the type of an image while preventing or reducing the load on a memory or a CPU enables providing an image forming apparatus capable of not only preventing or reducing the degradation of FPOT but also making power consumption appropriate.

In the above-described first exemplary embodiment, the method of discriminating the type of an image by obtaining the maximum value Y with respect to the numerical value X obtained by adding together the printing ratios in each area has been described. In a second exemplary embodiment, a method of discriminating the type of an image by obtaining a difference between the numerical values X in two areas is described. Furthermore, with regard to a configuration similar to that in the above-described first exemplary embodiment, such as the configuration of the image forming apparatus, the detailed description thereof is omitted here.

[Method of Calculating Fixing Temperature]

Besides, for example, halftoning processing for a gray scale image, the image processing unit 303 also performs processing for calculating the fixing temperature from image information. Hereinafter, a specific method of calculating the fixing temperature is described. Furthermore, in the second exemplary embodiment, first, the image processing unit 303 serving as a conversion unit also calculates a printing ratio from image information. In that process, the image processing unit 303 calculates a printing ratio with "the entire region in the main scanning direction×2 mm in the sub-scanning direction" used as one area. In other words, the image processing unit 303 calculates a printing ratio based on conversion data which is obtained by converting image data into data divided into areas having a first resolution in the main scanning direction and a second resolution higher than the first resolution in the sub-scanning direction. However, the method of dividing image data into areas is not limited to this, but image data can be divided into a plurality of areas in the main scanning direction, or a range longer than 2 mm in the sub-scanning direction can be set as one area. The method of division into areas can be set as appropriate in view of, for example, the accuracy of a fixing temperature desired to be controlled, the time required for control, or the processing capability of the printer control unit 304.

In the second exemplary embodiment, the method to be described here repeatedly calculates a difference between printing ratios of two areas contiguous in the sub-scanning direction, and sets the sum of the calculated differences between printing ratios as a difference value S. Then, the method sets the printing ratio of the entire image area as a printing ratio D. The method sets a value obtained by dividing the difference value S by the printing ratio D as a printing ratio difference G, discriminates the type of an image according to whether the printing ratio difference G is larger than a threshold value T, and controls the fixing temperature according to the discriminated type of the image.

Figure 9:
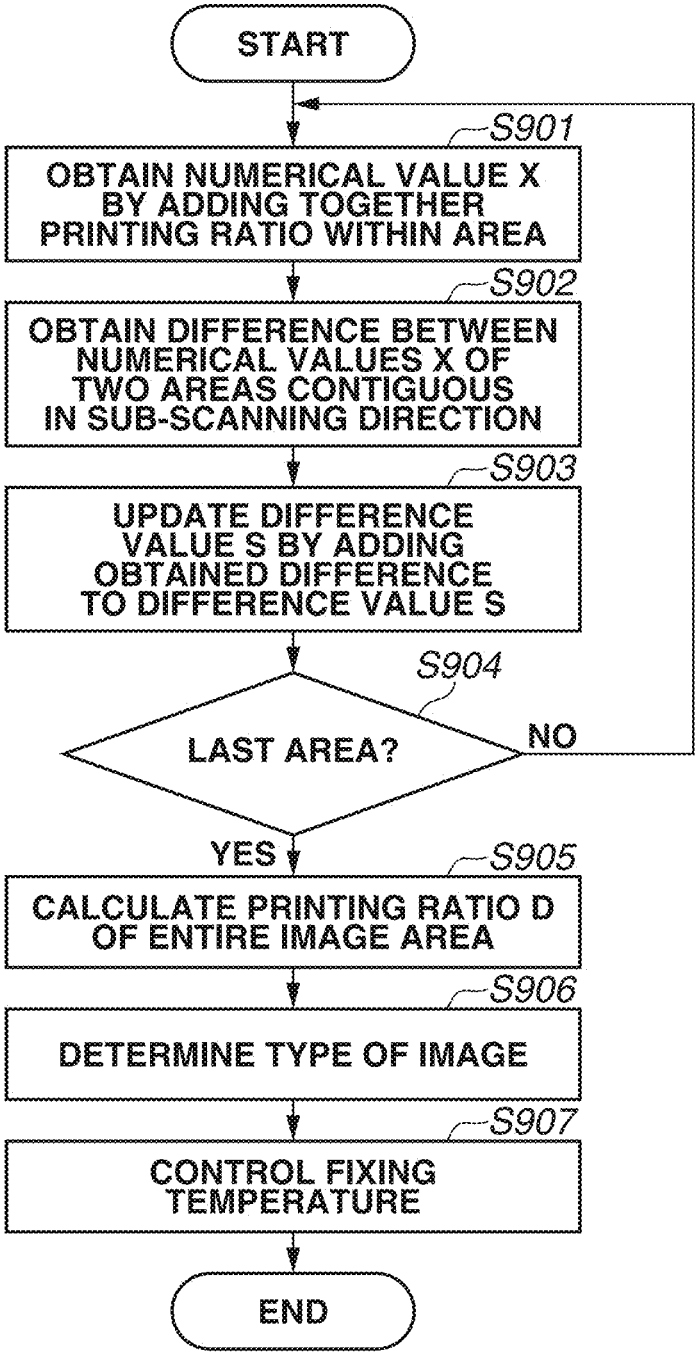
FIG. 9 is a flowchart illustrating a method of controlling the fixing temperature.

FIG. 9 is a flowchart illustrating the method of controlling the fixing temperature in the second exemplary embodiment. In step S901, with regard to two areas contiguous in the sub-scanning direction, the image processing unit 303 serving as a conversion unit adds together printing ratios within each area, thus obtaining a numerical value X. In step S902, the image processing unit 303 serving as an analysis unit obtains a difference between the numerical values X of two areas contiguous in the sub-scanning direction. In step S903, the image processing unit 303 adds the difference obtained in step S902 to the difference value S, thus updating the difference value S. In step S904, the image processing unit 303 determines whether the current area from which to calculate printing ratios is the last area. If it is determined that the current area is not the last area (NO in step S904), the processing returns to step S901, in which the image processing unit 303 repeats the processing, and, if it is determined that the current area is the last area (YES in step S904), the processing proceeds to step S905.

In step S905, the image processing unit 303 calculates the printing ratio D in the entire image area. In step S906, the image processing unit 303 serving as an analysis unit discriminates the type of an image based on the calculated difference value S and printing ratio D. Specifically, first, if the printing ratio D in the entire image area is less than 1% serving as a third threshold value (less than the third threshold value), the image processing unit 303 determines that the image is the pattern A. Moreover, if the printing ratio D in the entire image area is greater than or equal to 25% serving as a fourth threshold value (greater than or equal to the fourth threshold value), the image processing unit 303 determines that the image is the pattern B. Thus, the image processing unit 303 is able to discriminate the type of an image by analyzing numerical values that are based on the numerical value X obtained by converting image data. Furthermore, here, similar to the above-described first exemplary embodiment, as an example, for ease of explanation, the method of dividing images into two patterns is described. However, the second exemplary embodiment is not limited to this, but the types of images can be divided into two or more patterns so as to more finely control the fixing temperature.

Additionally, in a case where the printing ratio D is 1% or more and less than 25%, the image processing unit 303 determines the image by comparing the numerical values X of a plurality of areas. Specifically, the image processing unit 303 determines whether, in 10 contiguous areas, there is an area in which the numerical value X thereof becomes smaller than the lower limit threshold value W serving as a fifth threshold value. If, in 10 areas, there is no area in which the numerical value X thereof becomes smaller than the lower limit threshold value W, the image processing unit 303 can determine that images with a high printing ratio are contiguously formed in the sub-scanning direction, and, therefore, determines that the image is the pattern B.

Furthermore, even in the second exemplary embodiment, as with the first exemplary embodiment, the lower limit threshold value W was set to 0.04 (4%). In a case where the numerical value X smaller than the lower limit threshold value W is not present in 10 contiguous areas, the image processing unit 303 can determine that a vertical band image with a length of about 20 mm or more is formed. In view of the fixing device 6 in the second exemplary embodiment, when images with a predetermined printing ratio or more are contiguous as much as 20 mm or more, since it may become impossible to secure fixability, the image processing unit 303 determines that the image is the pattern B. Moreover, while, here, as an example, 10 areas are used as a criterion for determination, the second exemplary embodiment is not limited to this, but the number of areas can be set as appropriate depending on, for example, the fixing performance of the fixing device 6.

Moreover, in a case where the printing ratio D is 1% or more and less than 25% and, in 10 contiguous areas, there is an area in which the numerical value X becomes smaller than the lower limit threshold value W, the image processing unit 303 obtains the printing ratio difference G. The printing ratio difference G is obtained by dividing the difference value S by the printing ratio D. If the printing ratio difference G is larger than or equal to the threshold value T serving as a sixth threshold value, the image processing unit 303 can determine that the image is the pattern A. On the other hand, if the printing ratio difference G is smaller than the threshold value T, the image processing unit 303 can determine that the image is the pattern B.

Furthermore, the printing ratio difference G being larger indicates that a difference in printing ratio between areas is larger. In other words, in the case of, for example, a text image, a situation in which there is a space between lines in the text image can be determined. On the other hand, the printing ratio difference G being smaller indicates that a difference in printing ratio between areas is smaller. In other words, there is a high possibility of the case of forming an image like a lump partially high in printing ratio or the case of forming an image like a vertical band in which images are contiguous in the sub-scanning direction. Therefore, it is desirable that the threshold value T be set in such a way as to enable determining whether the image is such a text image. In the second exemplary embodiment, in view of characteristics of a usual text image, the threshold value T was set to 35.

In step S907, the engine control unit 302 serving as a temperature control unit controls the fixing temperature according to the type of an image obtained as a result of analysis. Specifically, the engine control unit 302 performs control based on a temperature control table shown in the following table (5) in such a manner that, if the image is the pattern A, the fixing temperature is set to 190° C. and, if the image is the pattern B, the fixing temperature is set to 210° C.

TABLE (5)

| Temperature control table | |
|---|---|
| | Fixing temperature T ° C. |
| Pattern A | 190 |
| Pattern B | 210 |

Performing the method of controlling the fixing temperature in the above-described way enables appropriately controlling the fixing temperature according to the type of an image. For example, an image the printing ratio D of which is less than 1% can be determined to be an easy-to-fix image (pattern A), so that control can be performed such that the fixing temperature is set low. An image the printing ratio D of which is 1% or more and less than 25% and in which, in 10 areas contiguous in the sub-scanning direction, the numerical value X of at least one area is smaller than the lower limit threshold value W and the printing ratio difference G is larger than the threshold value T can be determined to be an easy-to-fix image (pattern A). Accordingly, control can be performed such that the fixing temperature is set low.

An image the printing ratio D of which is 1% or more and less than 25% and in which, in 10 areas contiguous in the sub-scanning direction, the numerical value X of at least one area is smaller than the lower limit threshold value W and the printing ratio difference G is smaller than the threshold value T can be determined to be a difficult-to-fix image (pattern B). Accordingly, control can be performed such that the fixing temperature is set high. An image the printing ratio D of which is 1% or more and less than 25% and in which, in 10 areas contiguous in the sub-scanning direction, the numerical value X of each area is larger than or equal to the lower limit threshold value W can be determined to be a difficult-to-fix image (pattern B). Accordingly, control can be performed such that the fixing temperature is set high. An image the printing ratio D of which is 25% or more can be determined to be a difficult-to-fix image (pattern B), so that control can be performed such that the fixing temperature is set high.

Furthermore, while, here, as an example, the method in which steps S901 to S906 are performed by the image processing unit 303 and step S907 is performed by the engine control unit 302 has been described, the second exemplary embodiment is not limited to this. For example, processing in step S901 can be performed by the image processing unit 303 and processing in steps S902 to S907 can be performed by the engine control unit 302. In this case, since the image processing unit 303 only needs to transmit not image data itself but the numerical value X obtained by conversion in each area to the engine control unit 302, there is also such an advantageous effect that the communication volume can be reduced. Moreover, image data itself can be transmitted from the image processing unit 303 to the engine control unit 302 and processing in steps S901 to S907 can be performed by the engine control unit 302. Moreover, processing in steps S901 to S906 can be performed by a server connected to the image forming apparatus via a network. Thus, an image forming system or an image forming method for performing the above-described processing can be attained.

Figures 10A, 10B:
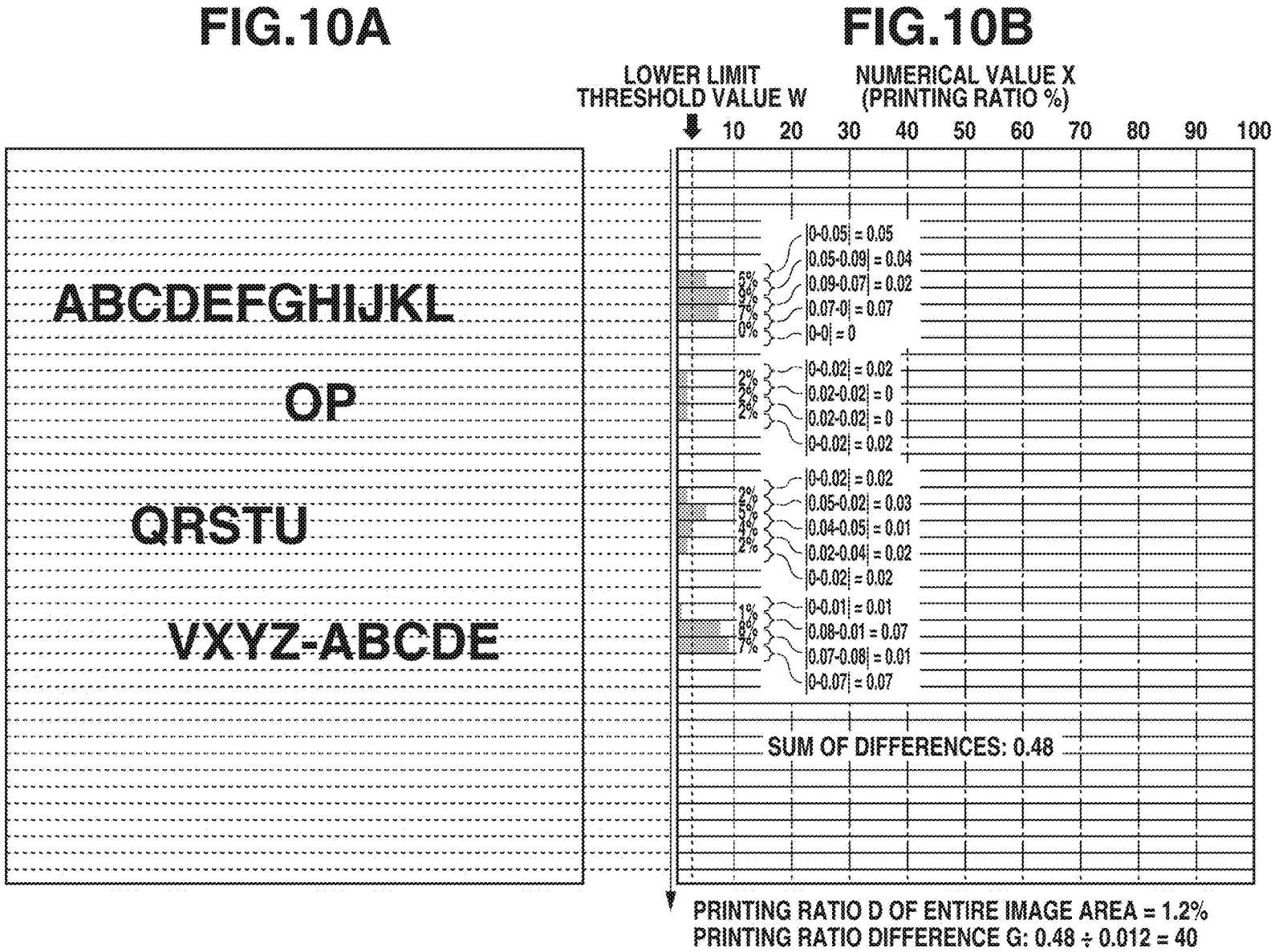
FIGS. 10A and 10B are diagrams illustrating a result of the method of controlling the fixing temperature being performed.

FIGS. 10A and 10B and FIGS. 11A and 11B are diagrams illustrating results obtained by performing the method of controlling the fixing temperature in the second exemplary embodiment with respect to respective images as examples. FIG. 10A illustrates an image to be formed on a recording material P. Here, an image in which text is formed is illustrated as an example. FIG. 10B illustrates specific numerical values obtained in a case where the method of controlling the fixing temperature in the second exemplary embodiment has been performed.

FIG. 10A illustrates an image in which the printing ratio D of the entire image area is 1.2%. The printing ratio D of the entire image area corresponds to 1% or more and less than 25%. Moreover, in 10 areas contiguous in the sub-scanning direction, the numerical value X of at least one area is smaller than the lower limit threshold value W. Accordingly, the obtained printing ratio difference G becomes "the difference value S (0.48)/the printing ratio D (0.012)"=40. Since there is a relationship of "the printing ratio difference G (40)>the threshold value T (35)", the image illustrated in FIG. 10A can be determined to be an easy-to-fix image (pattern A), so that control can be performed such that the fixing temperature is set to 190° C.

Figure 11A:
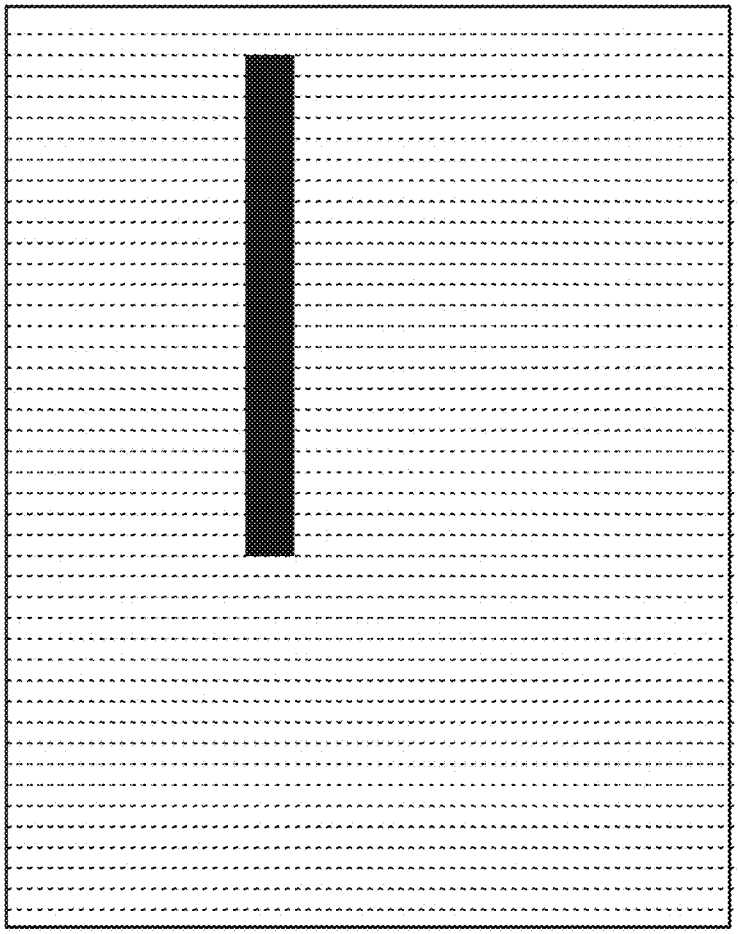
FIGS. 11A and 11B are diagrams illustrating a result of the method of controlling the fixing temperature being performed.
Figure 11B:
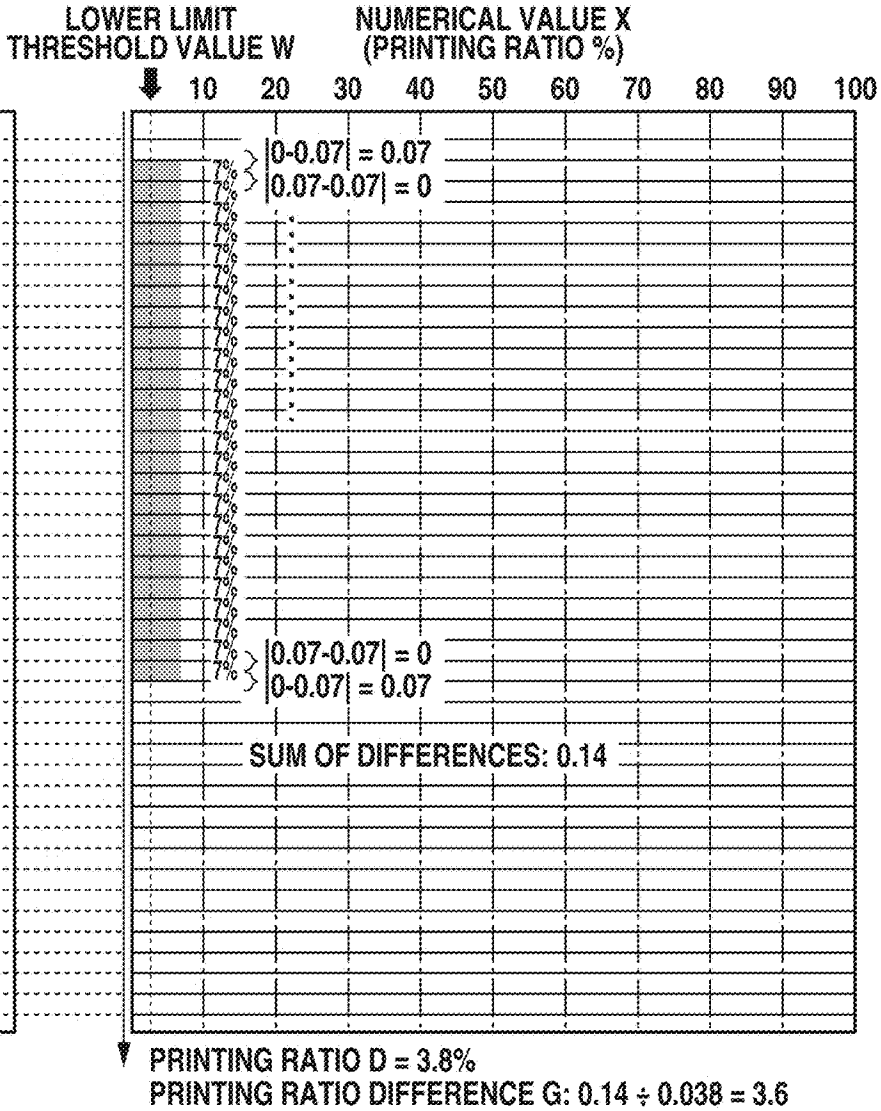

FIG. 11A illustrates an example of an image to be formed on a recording material P. Here, an image in which a vertical band in which images are contiguous in the sub-scanning direction is formed is illustrated as an example. FIG. 11B illustrates specific numerical values obtained in a case where the method of controlling the fixing temperature in the second exemplary embodiment has been performed.

FIG. 11A illustrates an image in which the printing ratio D of the entire image area is 3.8%. The printing ratio D of the entire image area corresponds to 1% or more and less than 25%. In 10 areas contiguous in the sub-scanning direction, the numerical value X of each area is larger than or equal to the lower limit threshold value W. Accordingly, the image illustrated in FIG. 11A can be determined to be a difficult-to-fix image (pattern B), so that control can be performed such that the fixing temperature is set to 210° C.

FIG. 8 illustrates examples of images having various patterns formed on recording materials P, including an image 1 to an image 6. Results obtained by performing the method of controlling the fixing temperature in the second exemplary embodiment on these images are shown in Table (6).

TABLE (6)

| Image types in second exemplary embodiment | | | | |
|---|---|---|---|---|
| | Second exemplary embodiment | | | |
| | Printing ratio D | Printing ratio difference G (threshold value T: 35) | In each of 10 contiguous areas, numerical value X is larger than lower limit threshold value W (0.4%). | Image type |
| Image 1 | 5% | 200 | No | Pattern A |
| Image 2 | 0.8% | 600 | No | Pattern A |
| Image 3 | 8% | 100 | Yes | Pattern B |
| Image 4 | 5% | 130 | No | Pattern A |
| Image 5 | 5% | 3 | Yes | Pattern B |
| Image 6 | 21% | 28 | No | Pattern B |

The image 1 represents an image in which a lattice is formed over the entire image area and text is partially formed. The printing ratio D of the entire image area is 1% or more and less than 25%. The numerical value X in each area is low, so that the difference value S between areas becomes large. Accordingly, since the printing ratio difference G becomes larger than the threshold value T, the image 1 can be discriminated to be the pattern A.

The image 2 represents an image in which text is formed at a part of the central portion of the image and the printing ratio is low throughout the entire image area. Since the printing ratio D of the entire image area becomes less than 1%, the image 2 can be determined to be the pattern A.

The image 3 represents an image in which, although the printing ratio of the entire image is low, the printing ratio of a trailing edge portion in the sub-scanning direction is high. The printing ratio D of the entire image area is 1% or more and less than 25%. Although the printing ratio difference G becomes larger than the threshold value T, with regard to images at the trailing edge portion in the sub-scanning direction, in 10 areas contiguous in the sub-scanning direction, the numerical value X of each area becomes larger than or equal to the lower limit threshold value W. Accordingly, the image 3 can be determined to be the pattern B.

The image 4 represents an image in which text is formed throughout the entire image area. The printing ratio D of the entire image area is 1% or more and less than 25%. Since the difference value S becomes large between a text portion and a space between lines in an image to be formed, so that the printing ratio difference G becomes larger than the threshold value T, and, accordingly, the image 4 can be determined to be the pattern A.

The image 5 represents an image in which, although the printing ratio of the entire image is low, images called a vertical band are contiguous in the sub-scanning direction. The printing ratio D of the entire image area is 1% or more and less than 25%. However, since the image 5 is a vertical band image in which images are contiguous in the sub-scanning direction, the difference value S in printing ratio becomes small. Accordingly, since the printing ratio difference G becomes smaller than the threshold value T, the image 5 can be determined to be the pattern B.

The image 6 represents an image in which images contiguous in the main scanning direction are formed at the leading edge portion, the central portion, and the trailing edge portion in the sub-scanning direction. The printing ratio D of the entire image area is 1% or more and less than 25%. With respect to the respective images contiguous in the main scanning direction, there are many blank spaces in the sub-scanning direction. Accordingly, the difference value S in printing ratio becomes small. While, in 10 areas contiguous in the sub-scanning direction, the numerical value X of each area becomes smaller than the lower limit threshold value W, since the printing ratio difference G becomes smaller than the threshold value T, the image 6 can be determined to be the pattern B.

[Result of Study of Fixability]

A result of study of fixability in the second exemplary embodiment is shown in Table (7). Furthermore, in the second exemplary embodiment, as with the above-described first exemplary embodiment, under the environment of 25° C. in air temperature and 50% in humidity, image formation of each of the images 1 to 6 illustrated in FIG. 8 was performed continuously for 100 sheets, and the evaluation of fixability and electric power measured on that occasion was conducted.

TABLE (7)

| Result of study of fixability | | | | | | | |
|---|---|---|---|---|---|---|---|
| | | Images | | | | | |
| | | 1 | 2 | 3 | 4 | 5 | 6 |
| Second exemplary embodiment | Fixability | AA | AA | AA | AA | AA | AA |
| | Fixing temperature (° C.) | 190 | 190 | 210 | 190 | 210 | 210 |
| | Electric power (Wh) | 25.8 | 25.8 | 27.7 | 25.8 | 27.7 | 28.0 |

As can be understood from the above table (7), performing the method of controlling the fixing temperature in the second exemplary embodiment makes fixability good in all of the images, i.e., the image 1 to the image 6. Additionally, since it can be appropriately determined that, depending on the type of an image, fixability is able to be satisfied even when the fixing temperature is lowered, power consumption can be reduced to a low value with respect to, for example, the images 1, 2, and 4.

In the above-described way, the method of controlling the fixing temperature in the second exemplary embodiment is able to appropriately control the fixing temperature by analyzing the printing ratio of an image to be formed and discriminating the type of the image. For example, in a method of controlling the fixing temperature according to the printing ratio of an image to be formed, depending on the type of the image, a difference may in some cases occur between the fixing temperature to be set and an optimum fixing temperature. Usually, in a case where a high-density region is present in the image area, a large quantity of heat is drawn from the fixing device 6 during fixing of a recording material P. Additionally, with regard to an image, such as a vertical band, in which high-density regions are contiguous in the sub-scanning direction, since heat is continuously drawn from a specific portion of the heating member (film unit) 10, even when the printing ratio of the entire image is low, a high fixing temperature becomes required. Using the method of controlling the fixing temperature in the second exemplary embodiment enables appropriately controlling the fixing temperature even in such a situation.

Moreover, for example, in the case of an image composed of text, heat is unlikely to be drawn from the heating member 10. Usually, a text image has spaces between lines in many cases, so that a line on which an image is formed and a line in which no image is formed may be present in the sub-scanning direction. With respect to a text image having such features, heat is not continuously drawn from the heating member 10 as compared with an image such as a vertical band in which images are contiguous. Therefore, as compared with an image such as a vertical band having the same printing ratio, even when the fixing temperature is lowered, fixability can be ensured. Although, even if the fixing temperature is simply controlled according to the printing ratio, it is impossible to appropriately control the fixing temperature in the above-described way according to the type of an image, using the method of controlling the fixing temperature in the second exemplary embodiment makes it possible to appropriately control the fixing temperature in such a situation. In other words, even when the fixing temperature is lowered according to the type of an image, it is possible to satisfy fixability and it is also possible to reduce power consumption to a low value.

In the second exemplary embodiment, the printing ratio is calculated, for example, with "the entire region in the main scanning direction×2 mm in the sub-scanning direction" set as one area. Even when image data is not finely divided into areas, conceiving a technique such as the method of controlling the fixing temperature in the second exemplary embodiment enables discriminating the type of an image based on an increase or decrease in printing ratio between areas in the sub-scanning direction. Thus, it is possible to prevent or reduce an increase in cost of a configuration required for controlling the fixing temperature, such as a memory or a CPU. Performing fixing at an appropriate fixing temperature corresponding to the type of an image while preventing or reducing the load on a memory or a CPU enables providing an image forming apparatus capable of not only preventing or reducing the degradation of FPOT but also making power consumption appropriate.

Furthermore, in the first exemplary embodiment or the second exemplary embodiment, image analysis with a large load, such as character recognition, is not performed. Therefore, a text image such as that illustrated in FIG. 12 cannot be discriminated as a text image. However, even if such an image cannot be specifically discriminated as a text image, it is possible to appropriately control the fixing temperature based on printing ratios and a distribution of images, as in the first exemplary embodiment or the second exemplary embodiment.

Moreover, while, in the first exemplary embodiment and the second exemplary embodiment, image analysis processing is performed by the image processing unit 303, the first and second exemplary embodiments are not limited to this. For example, a part or the whole of image analysis processing can be performed by, for example, the engine control unit 302 or a program stored in a host computer or a server on a network.

Moreover, while, in the first exemplary embodiment and the second exemplary embodiment, as an example, the method of obtaining printing ratios has been described, the first and second exemplary embodiments are not limited to this. For example, a method of obtaining the area of an image to be formed for use in making a determination can be employed. For example, the method obtains the maximum area of an image to be formed based on the size of a recording material and sets an area equivalent to the area of, for example, 4% of the maximum area as the lower limit threshold value W, thus enabling controlling the fixing temperature without having to calculate the printing ratios. Thus, both the printing ratio and the area of an image can be referred to values related to areas of an image to be formed, and the fixing temperature can be controlled based on the values related to areas of an image.

Modification Examples

While, in the above-described first exemplary embodiment and second exemplary embodiment, the description has been performed with a monochroic image used as a controlled object, the first and second exemplary embodiments are not limited to this. For example, in a color laser beam printer which forms a color image with use of toners of four colors, yellow (Y), magenta (M), cyan (C), and black (K), a color image can also be used as a controlled object. For example, in a color image, pieces of image data of Y, M, C, and K are added together according to image forming positions and are thus treated as one piece of image data for use in performing control. In that case, when the maximum density of each color is assumed to be 100%, if image formation is performed with the maximum densities of all of the four colors, the color image is provided with a density of 400%.

For example, in the first exemplary embodiment, the method can calculate the numerical value X in one area as a value obtained by adding together images for four colors. Then, the method calculates the numerical value X in each area, and obtains the maximum value Y. The method sets the upper limit threshold value Z for a color image as 0.4, and makes a comparison with the maximum value Y. If the maximum value Y is smaller than the upper limit threshold value Z, the method can determine that the color image is an easy-to-fix image (pattern A), and, if the maximum value Y is larger than or equal to the upper limit threshold value Z, the method can determine that the color image is a difficult-to-fix image (pattern B). In this way, the method of controlling the fixing temperature described in the first exemplary embodiment can also be implemented for a color image.

Moreover, for example, even in the second exemplary embodiment, the method can calculate the numerical value X in one area as a value obtained by adding together images for four colors. Then, the method calculates the numerical value X in each area, and obtains the printing ratio difference G. Then, the method also obtains the printing ratio D of the entire image area. The method of controlling the fixing temperature described in the second exemplary embodiment can also be implemented for a color image based on such obtained values.

According to aspects of the present disclosure, a method of controlling the fixing temperature while preventing or reducing an increase in cost of a configuration required for controlling the fixing temperature can be provided.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. An image forming apparatus comprising:

an image forming unit configured to form an image by performing scanning with a laser beam in a main scanning direction based on image data;

a fixing unit configured to fix the image formed on a recording material by the image forming unit;

a transmission unit configured to transmit values relating to pixels that form the image in the image data, in each of a plurality of lines in a sub-scanning direction orthogonal to the main scanning direction; and a control unit configured to calculate, in a case where the values relating to the pixels that form the image are consecutively greater than or equal to a predetermined value in the sub-scanning direction, an integrated value of the values relating to the pixels that form the image, wherein the fixing unit is set to a first temperature in a case where the integrated value is a first value, and the fixing unit is set to a second temperature lower than the first temperature in a case where the integrated value is a second value smaller than the first value.

2. The image forming apparatus according to claim 1, wherein the transmission unit transmits a value obtained by adding the values relating to the pixels that form the image in one line in the sub-scanning direction.

3. The image forming apparatus according to claim 2, wherein the control unit calculates the integrated value by integrating the values relating to the pixels that form the image until the calculated integrated value becomes smaller than a predetermined value, and compares the calculated integrated value with a maximum value of previously calculated integrated values to determine whether the calculated integrated value is larger than a maximum value of previously calculated integrated values.

4. The image forming apparatus according to claim 3, wherein, in a case where the calculated integrated value is greater than the maximum value, the control unit updates the maximum value to the calculated integrated value.

5. The image forming apparatus according to claim 3, wherein a type of the image is determined by comparing the maximum value and a first threshold value.

6. The image forming apparatus according to claim 1, wherein the predetermined value is a value for identifying whether the line in the sub-scanning direction is an inter-linear space.

7. An image forming system comprising:

an image forming unit configured to form an image by performing scanning with a laser beam in a main scanning direction based on image data;

a fixing unit configured to fix the image formed on a recording material by the image forming unit;

a transmission unit configured to transmit values relating to pixels that form the image in the image data, in each of a plurality of lines in a sub-scanning direction orthogonal to the main scanning direction; and a control unit configured to calculate, in a case where the values relating to the pixels that form the image are consecutively greater than or equal to a predetermined value in the sub-scanning direction, an integrated value of the values relating to the pixels that form the image, wherein the fixing unit is set to a first temperature in a case where the integrated value is a first value, and the fixing unit is set to a second temperature lower than the first temperature in a case where the integrated value is a second value smaller than the first value.

8. An image forming method for an image forming apparatus which forms an image by performing scanning with a laser beam in a main scanning direction based on image data and fixes the formed image on a recording material, the image forming method comprising:

transmitting values relating to pixels that form the image in the image data, in each of a plurality of lines in a sub-scanning direction orthogonal to the main scanning direction;

calculating, in a case where the values relating to the pixels that form the image are consecutively greater than or equal to a predetermined value in the sub-scanning direction, an integrated value of the values relating to the pixels that form the image; and setting the fixing unit to a first temperature in a case where the integrated value is a first value, and setting the fixing unit to a second temperature lower than the first temperature in a case where the integrated value is a second value smaller than the first value.

* * * * *